US006029991A

United States Patent [19]

Frey

[11] Patent Number: 6,029,991

[45] Date of Patent: Feb. 29, 2000

[54] IMPACT RELEASABLE SNOWBOARD BOOT BINDING ASSEMBLY AND METHOD

[76] Inventor: Bernard M. Frey, 2536 Piedmont Ave., Apt. #2, Berkeley, Calif. 94704

[21] Appl. No.: 08/816,351

[22] Filed: Mar. 13, 1997

[51] Int. Cl.[7] ..... A63C 9/081

[52] U.S. Cl. ..... 280/618; 280/613

[58] Field of Search ..... 280/611, 613, 280/615–618, 633, 634, 11.3

[56] References Cited

U.S. PATENT DOCUMENTS

| | | | |
|---|---|---|---|
| 4,652,007 | 3/1987 | Dennis | 280/618 |
| 4,728,116 | 3/1988 | Hill | 280/618 |
| 4,973,073 | 11/1990 | Raines et al. | 280/624 |
| 5,035,443 | 7/1991 | Kincheloe | 280/618 |
| 5,143,396 | 9/1992 | Shaanan et al. | 280/607 |
| 5,145,202 | 9/1992 | Miller | 280/613 |
| 5,190,311 | 3/1993 | Carpenter et al. | 280/618 |
| 5,261,689 | 11/1993 | Carpenter et al. | 280/618 |
| 5,299,823 | 4/1994 | Glaser | 280/625 |
| 5,338,051 | 8/1994 | Szafranski et al. | 280/607 |
| 5,354,088 | 10/1994 | Vetter et al. | 280/618 |
| 5,356,159 | 10/1994 | Butterfield | 280/14.2 |
| 5,356,170 | 10/1994 | Carpenter et al. | 280/618 |
| 5,362,087 | 11/1994 | Agid | 280/611 |
| 5,401,041 | 3/1995 | Jespersen | 280/14.2 |
| 5,409,244 | 4/1995 | Young | 280/14.2 |
| 5,417,443 | 5/1995 | Blattner et al. | 280/14.2 |
| 5,474,322 | 12/1995 | Perkins et al. | 280/613 |
| 5,480,176 | 1/1996 | Sims | 280/618 |
| 5,499,837 | 3/1996 | Hale et al. | 280/607 |
| 5,505,477 | 4/1996 | Turner et al. | 280/613 |
| 5,505,478 | 4/1996 | Napoliello | 280/618 |
| 5,520,405 | 5/1996 | Bourke | 280/613 |
| 5,520,406 | 5/1996 | Anderson et al. | 280/624 |
| 5,538,272 | 7/1996 | Peart | 280/602 |
| 5,695,210 | 12/1997 | Goss | 280/624 |
| 5,782,476 | 7/1998 | Fardie | 280/14.2 |

*Primary Examiner*—Christopher P. Schwartz
*Assistant Examiner*—C. T. Bartz

[57] ABSTRACT

An impact release binding assembly for a snowboard which separates into two parts upon a sufficient impact subjected on the binding assembly regardless of the direction of the impact origin. The binding apparatus includes a boot plate coupled to the boot, and a latch assembly movable between a latched position and an unlatched position. In the latched position, the latch assembly releasably mounts the boot plate to the snowboard, while in the unlatched position, the latch assembly releases the boot plate from the snowboard. An inertia block is provided, having a selected mass, and formed to retain the latch assembly in the latched position until a sufficient inertial force dislodges the inertia block from supportive contact with the latch assembly. Upon being dislodged, the latch assembly is caused to move from a support position, supportably retaining the latch assembly in the latched position, to a release position, releasing the latch assembly to the unlatched position in the event of the sufficient inertial force. The latch assembly preferably includes a first latch mechanism and a second latch mechanism. The first latch mechanism is maintained in the latched position until a sufficient first inertial force of at least a predetermined amount and in a direction from about 0° to about 180° relative a plane extending through the latch assembly causes the first latch mechanism to move to the unlatched position. The second latch mechanism, in contrast, is maintained in the latched condition until a sufficient second inertial force of at least a predetermined amount and in a direction from about 180° to about 360° relative the plane extending through the latch assembly causes the second latch mechanism to move to the unlatched condition.

45 Claims, 15 Drawing Sheets

IMPACT RELEASABLE SNOWBOARD BOOT BINDING ASSEMBLY AND METHOD

TECHNICAL FIELD

The present invention relates, generally, to boot binding assemblies, and more particularly, relates to impact releasably boot binding assemblies for snowboards.

BACKGROUND ART

Recently, the winter sport of snowboarding has experienced an explosive growth in popularity in the United States as well as other countries worldwide. Due in part to the popularity and relative infancy of this sport, snowboarding equipment is evolving at a rapid pace.

One area of substantial development is the manner in which a snowboarder is mounted to the snowboard. Unlike conventional snow skiing, both feet of the snowboarder are mounted to a single snowboard, and snowboarding boots are generally relatively soft and are both strapped atop of the snowboard in a transverse or angled manner relative the length of the board. Another significant difference between the bindings is that conventional snow skiing bindings are designed to release upon sufficient torsional forces applied to the bindings via the foot of the skier. Snowboarding bindings, on the other hand, typically only release when the snowboarder manually releases the binding. Hence, the snowboarder remains bound to the snowboard regardless of the magnitude of the fall.

The primary reason safety release bindings are considered unnecessary in snowboarding is that the twisting forces exerted on the body during a fall are more absorbed by the torso of the snowboarder rather than the individual ankles or knees. In contrast, the torsional forces associated with snow skiing experienced during a fall is more often absorbed by the ankles and knees of the skier sometimes resulting in injury.

However, snowboard related knee injuries are not uncommon, and there is an increasing concern that these manual-only releasable bindings may partially be responsible for these injuries. As a result, numerous releasable bindings have been developed which are adapted to release one or both of the snowboarders boots from the bindings upon sufficient twisting or torsional forces acting on the binding. Typical of these patented torsional release bindings are disclosed in U.S. Pat. Nos.: 4,652,007 to Dennis; 4,728,116 to Hill; and 5,145,202 to Miller.

One significant drawback for these torsional-type releasable bindings, however, is that to impact release the boot from the binding, a sufficient torsional force must be directly exerted on the binding from the boot of the snowboarder. For example, similar to snow ski bindings, release of the binding occurs when the snowboarder is forced sufficiently forward so that the forward twisting of the snowboarder releases the binding. The other way these bindings release is when the snowboarder exerts sufficient torsional forces, in a plane parallel to the snowboard, to twist the boot from the binding. Often, these torsional forces which are absorbed partially by the knees are still sufficient to cause significant injury to the snowboarder.

DISCLOSURE OF INVENTION

Accordingly, it is an object of the present invention to provide an impact release binding assembly for a snowboard which reduces the risk of injury.

Another object of the present invention is to provide an impact release binding assembly for a snowboard which is capable of release regardless of the direction of impact exerted on the binding.

Still another object of the present invention is to provide an impact release binding assembly can be easily reset for mounting the snowboard to the boot.

Yet another object of the present invention is to provide an impact release binding assembly which enables adjustment of the relative mounting stance of the snowboarder to the snowboard.

It is a further object of the present invention to provide an impact release binding assembly which is durable, compact, easy to maintain, has a minimum number of components, and is easy to use by unskilled personnel.

In accordance with the foregoing objects, the present invention provides an impact release binding assembly for separating a snowboarder from a snowboard upon a sufficient impact acting upon the binding assembly. Preferably, the impact release binding separates into two parts upon the horizontal component of an impact surpassing a predetermined degree, regardless of the direction of the impact origin. The binding apparatus includes a boot plate coupled to the boot, and a latch assembly movable between a latched position and an unlatched position. In the latched position, the latch assembly releasably mounts the boot plate to the snowboard, while in the unlatched position, the latch assembly releases the boot plate from the snowboard. An inertia block is provided, having a selected mass, and formed to retain the latch assembly in the latched position until a sufficient inertial force dislodges the inertia block from supportive contact with the latch assembly. Upon being dislodged, the latch assembly is caused to move from a support position, supportably retaining the latch assembly in the latched position, to a release position, releasing the latch assembly to the unlatched position in the event of the sufficient inertial force.

In the preferred form, the binding apparatus includes a biasing device operably coupled to the latch assembly which biases the latch assembly toward the unlatched position. Thus, when the inertia block is moved to the release position, the latch assembly is automatically moved back toward the unlatched position. Moreover, after separation of the binding assembly, the binding can be manually reassembled and reset through a reset mechanism.

An alternative binding apparatus is provided including a boot plate coupled to the boot; and a latch assembly coupling the boot to the snowboard. The latch assembly includes a first latch mechanism and a second latch mechanism. The first latch mechanism is inertially operable between an unlatched position, releasing the boot plate relative the snowboard, and a latched position, releasably mounting the boot plate to the snowboard. The first latch mechanism is maintained in the latched position until a sufficient first inertial force of at least a predetermined amount and in a direction from about 0° to about 180° relative a plane extending through the latch assembly causes the first latch mechanism to move to the unlatched position. Similarly, the second latch mechanism is inertially operable between an unlatched condition, releasing the boot plate relative the snowboard, and a latched condition, releasably mounting the boot plate to the snowboard. Again, the second latch mechanism is maintained in the latched condition until a sufficient second inertial force of at least a predetermined amount and in a direction from about 180° to about 360° relative the plane extending through the latch assembly causes the second latch mechanism to move to the unlatched condition.

BRIEF DESCRIPTION OF THE DRAWINGS

The assembly of the present invention has other objects and features of advantage which will be more readily apparent from the following description of the best mode of carrying out the invention and the appended claims, when taken in conjunction with the accompanying drawing, in which:

DETAILED DESCRIPTION OF THE INVENTION

Figure 1:
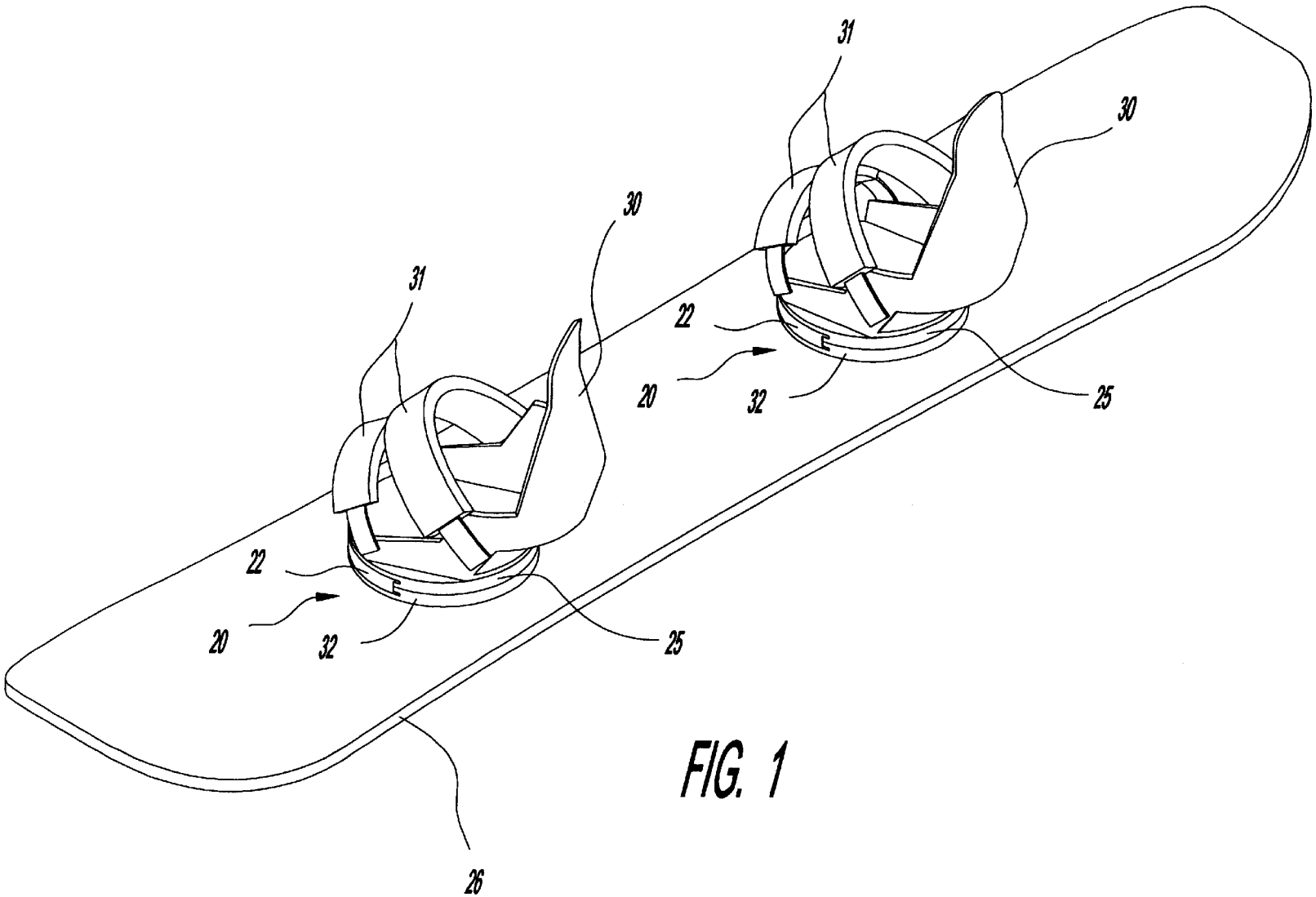
FIG. 1 is a top perspective view of a pair of impact release binding assemblies constructed in accordance with the present invention mounted to a snowboard.

While the present invention will be described with reference to a few specific embodiments, the description is illustrative of the invention and is not to be construed as limiting the invention. Various modifications to the present invention can be made to the preferred embodiments by those skilled in the art without departing from the true spirit and scope of the invention as defined by the appended claims. It will be noted here that for a better understanding, like components are designated by like reference numerals throughout the various figures.

Attention is now directed to FIGS. 1–4 where an impact release snowboard binding assembly, generally designated 20, is provided for releasably binding a person to a snowboard. The binding assembly includes an upper boot plate binding assembly 20 coupled to a snowboarder's boot (not shown), and a latch assembly, generally designated 22, movable between a latched position (FIGS. 3A, 5A, 6A and 7A) and an unlatched position (FIGS. 3B, 5B, 6B and 7B). In the latched position, latch assembly 22 releasably mounts boot plate 25 to snowboard 26; while in the unlatched position, latch assembly 22 releases boot plate 25 from snowboard 26. An inertia block, generally designated 27, is provided having a selected mass and which is formed to retain the latch assembly 22 in the latched position until a sufficient inertial force of at least a predetermined amount dislodges inertia block 27 from supportive contact with latch assembly 22. This causes the same to move from a support position (FIGS. 5A, 6A and 7A), supportably retaining latch assembly 22 in the latched position, and a release position (FIGS. 5B, 6B and 7B), releasing latch assembly 22 to the unlatched position should the binding assembly be subjected to the sufficient inertial force.

Accordingly, the binding assembly of the present invention provides a latch assembly and inertia block combination which enables impact release therebetween to release the snowboarder from the snowboard. Unlike conventional spring augmented or continuous load impact release bindings, the present invention does not rely upon torsional forces applied to the binding by the foot of the snowboarder to overcome the spring force. Rather, release of the latch assembly 22 is dependent upon an inertial force urged upon the inertia block which is sufficient to overcome the frictional forces retaining the same in supportive contact with the latch assembly. The release of the binding assembly, therefore, is not dependent upon a torsional force applied to the binding by a falling or twisting snowboarder. As a result, injuries are reduced.

Figure 2:
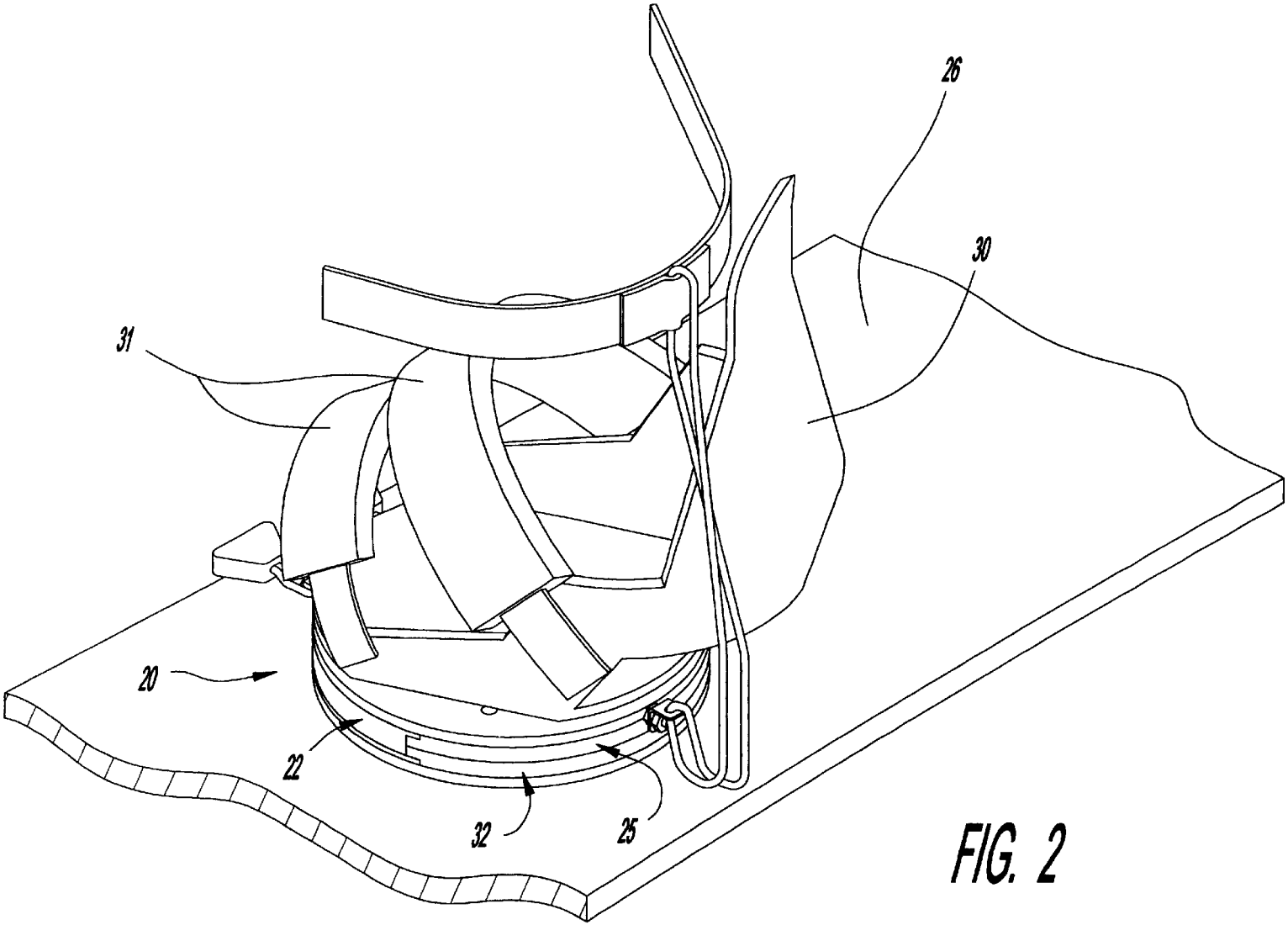
FIG. 2 is a fragmentary, enlarged top perspective view of the impact release binding assembly of FIG. 1.

As best viewed in FIG. 2, boot plate 25 is mountable to the bottom of a conventional boot binding fixture 30 which is releasably mountable to the boot. Briefly, these heel/strap bindings include a heel support formed for supportive receipt of a heel of a boot (not shown) therein. A pair of straps 31 generally extend over the fore foot of the boot to releasably strap the snowboard boot to the conventional binding and boot plate 25.

Figure 3B:
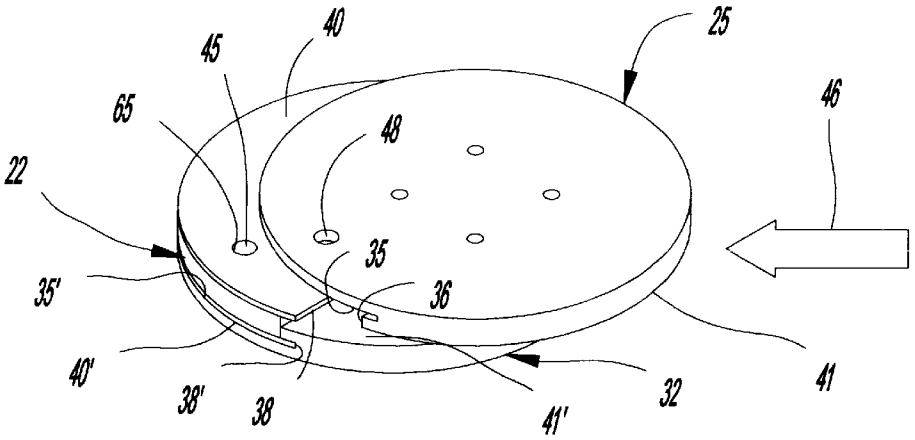
FIGS. 3A–3C are top perspective views of the impact release binding assembly of the present invention illustrating the three subassemblies and the impact direction dependent release of the latch assemblies.
Figure 3A:
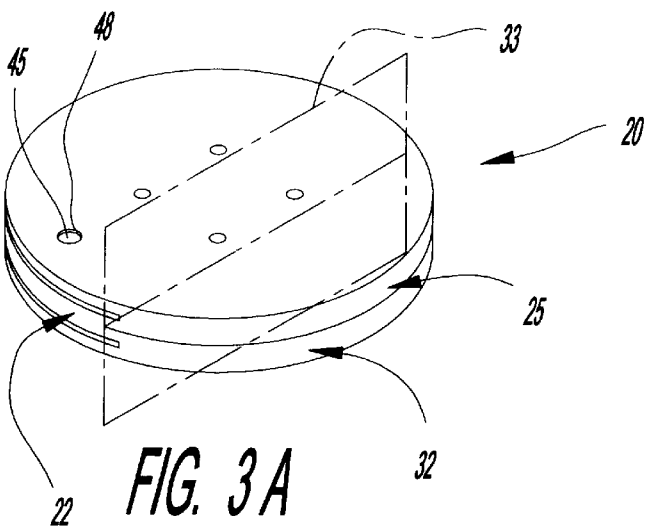
Figure 3C:
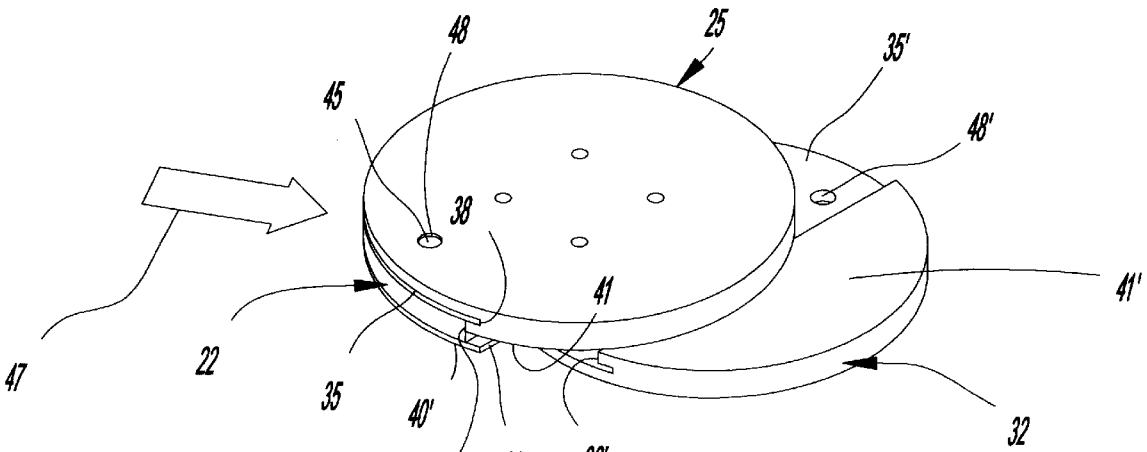

In the preferred form, the binding assembly 20 is separated into three subassemblies (FIGS. 3A–3C): boot plate 25, latch assembly 22 and a lower base plate 32, mountable to snowboard 26. Collectively, when the subassemblies are properly assembled and the latch assembly is in the latched position, the three subassemblies are lockably coupled to one another as a unit (FIG. 3A). Briefly, as will be described in greater detail below and as shown in FIGS. 3B and 3C, boot plate 25 will be released from the latch assembly 22/base plate 32 combination when inertial forces in the direction of about 0° to 180°, relative vertical plane 33 (FIG. 3A) extending vertically through binding assembly 20, are urged thereupon. Similarly, base plate 32 will be released from the latch assembly 22/boot plate 25 combination when inertial forces in the direction of about 180° to 360°, relative plane 33, are urged thereupon.

Boot plate 25 and base plate 32 are preferably provided by relatively thin circular plate members each releasably coupled, independently, to latch assembly 22 therebetween. Each plate 25, 32 includes an inward facing contact surface 35, 35' and opposed lip portions 36, 36', respectively, formed for interlocking with respective contact surfaces 40, 40' and opposed lip portions 38, 38' of latch assembly 22, each of which respectively extends laterally thereacross. Cooperation between the respective opposed contact surfaces (35, 40 and 35', 40'), the opposing support surfaces (41, 41') and interlocking lip portions (36, 38 and 36', 38') prevent relative twisting and vertical displacement therebetween to augment releasable coupling when the latch assembly is in the latched position. It will be understood, however, that this arrangement permits relative sliding movement between the respective plates 25, 32 and the unlatched position. D in the unlatched position. Due to the interlocking configuration between the cooperating contact surfaces and opposed lip portions, relative generally horizontal sliding movement between the base/boot plate and the latch assembly is permitted in directions about 0° to about 180° or about 180° to about 360° relative vertical plane 33 extending parallel the interlocking lip portions.

In the preferred embodiment, as will be discussed in greater detail below, latch assembly 22 includes a first latch mechanism 43 formed to releasably engage boot plate 25, and a second latch mechanism 43' formed to releasably engage base plate 32. The first latch mechanism 43 is inertially operable between a latched position (FIGS. 3A, 5A, 6A and 7A), releasably mounting the boot plate 25 to the snowboard 26, and an unlatched position (FIGS. 3B, 5B, 6B and 7B), releasing the boot plate 25 relative the snowboard 26 (i.e., releasing the boot plate 25 from the latch assembly/base plate combination). The first latch mechanism 43 remains in the latched position until a sufficient first inertial force (E.g., represented by arrow 46 in FIG. 3B) of at least a predetermined amount and in a direction from about 0° to about 180° relative the plane extending through the latch assembly 22 causes the first latch mechanism to move to the unlatched position. Similarly, the second latch mechanism 43' is inertially operable between a latched condition (FIGS. 3A, 9A and 10A), releasably mounting boot plate 25 to the snowboard 26, and an unlatched condition (FIGS. 3C, 9B and 10B), releasing the boot plate 25 relative the snowboard 26 (i.e., releasing the latch assembly/boot plate combination from the base plate 32). The second latch mechanism 43' remains in the latched condition until a sufficient second inertial force (E.g., represented by arrow 47 in FIG. 3C) of at least a predetermined amount and in a direction from about 180° to about 360° relative vertical plane 33 extending through the latch assembly causes the second latch mechanism to move to the unlatched condition.

Briefly, as will be described in greater detail below, each latch mechanism 43, 43' includes a latch member 45, 45' (FIGS. 4–6) formed to vertically protrude into and engage the interior walls of a respective receiving bore 48, 48' (FIGS. 3B and 3C) formed in the respective boot plate 25/base plate 32 when in the respective latched position/condition. Accordingly, cooperation between the respective latch members and the receiving bores, and the interlocking geometries of the base plate 32 and boot plate 25 relative the latch assembly housing 50 (i.e., the opposed lip portions and contact surfaces) prevent relative vertical and/or horizontal separation between the subassemblies when in the respective latched position/conditions.

For example, when the boot plate 25/base plate 32 and the latch assembly 22 are assembled for binding the snowboarder to the snowboard, as shown in FIG. 3A, and first latch mechanism 43/second latch mechanism 43' are positioned in the latched position/condition, the respective boot plate and base plate are prevented from horizontal separation relative the latch assembly. Furthermore, due to the interlocking nature of the opposed lip portions (36, 38 and 36', 38'), the opposed contacting surfaces (35, 40 and 35', 40'), and the opposed support surfaces (41, 42 and 41', 42'), relative twisting therebetween is also prevented.

Upon the binding assembly 20 being subject to an impact having a sufficient horizontal component in a direction about 0° to about 180° relative vertical plane 33 (E.g., represented by arrow 46 in FIG. 3B), the first inertia block 27 (FIG. 5B) will be dislodged from supportive contact with the first latch mechanism 43. As will be described below, upon movement of the first latch mechanism from the latched position to the unlatched position, the first latch member 45 is withdrawn from latched engagement with first receiving bore 48. Boot plate 25, hence, is then permitted to separate from latch assembly 22 in directions about 180° to about 360° relative plane 33 (FIG. 3B).

Similarly, upon an impact acting on the binding assembly 20 having a sufficient horizontal component in a direction about 180° to about 360° relative plane 33 (E.g., represented by arrow 47 in FIG. 3C), a second inertia block 27 (FIG. 9B) will be dislodged from supportive contact with the second latch mechanism 43'. As the second latch mechanism moves from the latched position to the unlatched position, the second latch member 45' is withdrawn from latched engagement with second receiving bore 48. The boot plate/latch assembly combination (due to the latched first latch mechanism 43) is then permitted to separate from base plate 32 as a unit in directions about 0° to about 180° relative plane 33 (FIG. 3C).

Figure 4:
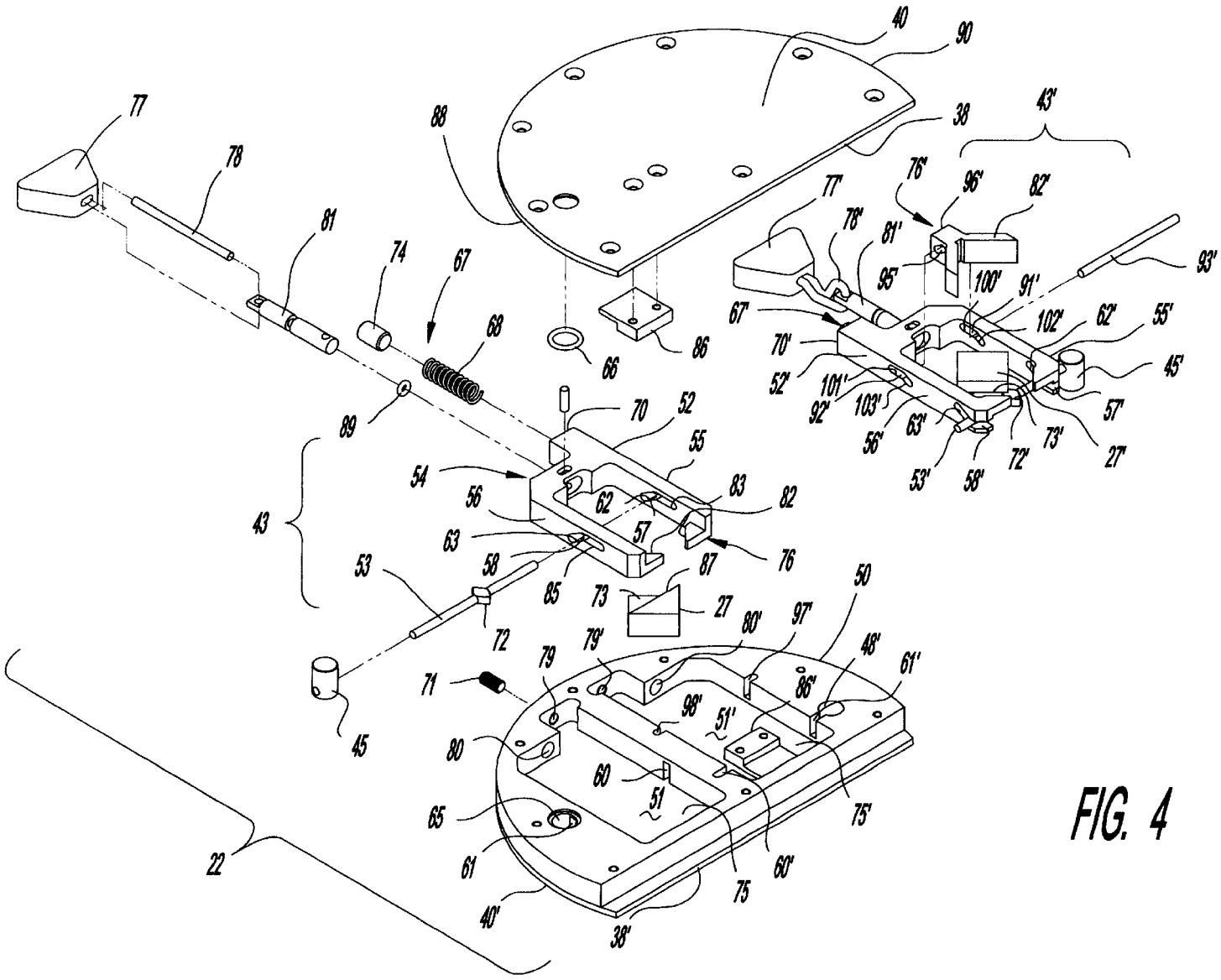
FIG. 4 is an enlarged, exploded view of the binding assembly of FIG. 1.

Turning now to FIG. 4, the components of the first latch mechanism 43 are described in detail. Briefly, latch assembly 22 includes a housing 50 defining a pair of side-by-side first and second cavities 51, 51' each formed for sliding support of a respective first latch mechanism 43 and second latch mechanism 43' therein. For the ease of understanding and the purposes of clarity, however, only the first latch mechanism 43 will be described in detail. Accordingly, the "first" and "second" references to common components between the first and second latch mechanism will be generally eliminated. It will be understood, however, that the first latch mechanism and the second latch mechanism operate identically, except that the two latch mechanisms are mirror images of one another for the most part. The minor differences therebetween will be highlighted below. Moreover, it will be understood that when the terms "horizontal" and "vertical" are applied, these terms are referenced to a level snowboard.

Figure 5A:
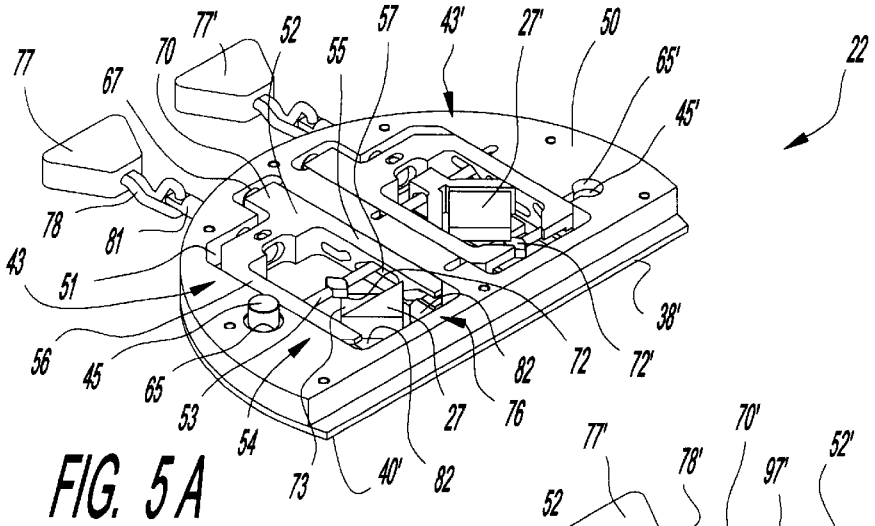
FIGS. 5A–5C is a series of top perspective views of the binding assembly of FIG. 1 illustrating operation of the first latch mechanism.
Figure 5B:
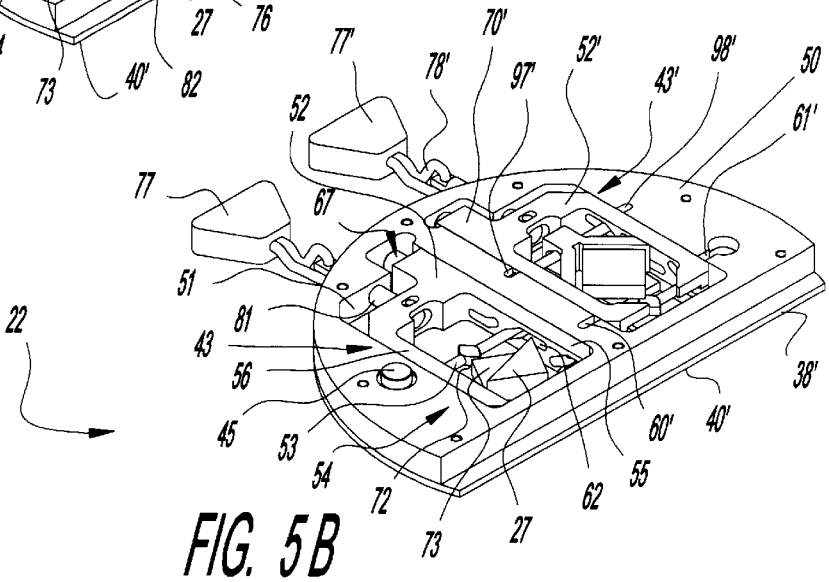
Figure 5C:
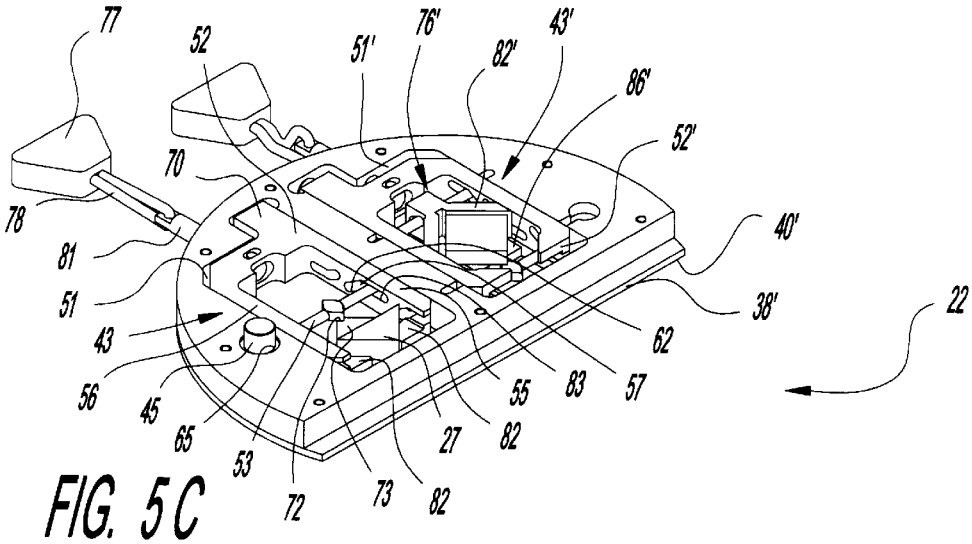
Figure 6A:
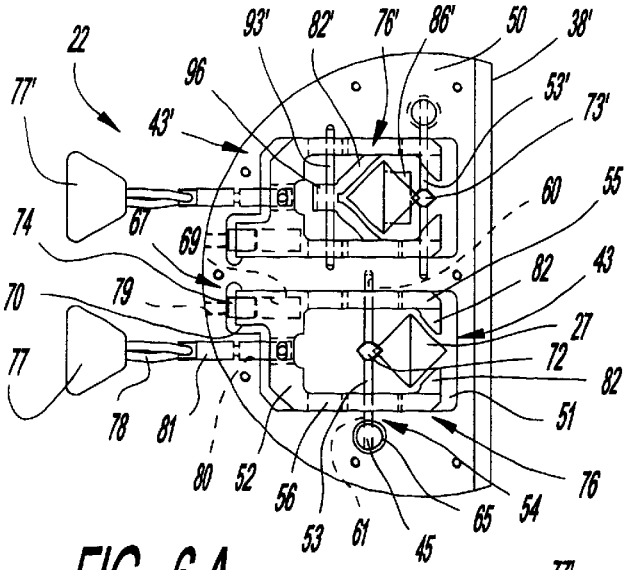
FIGS. 6A–6C is a series of top plan views corresponding to operation of the first latch mechanism of FIGS. 5A–5C.
Figure 6B:
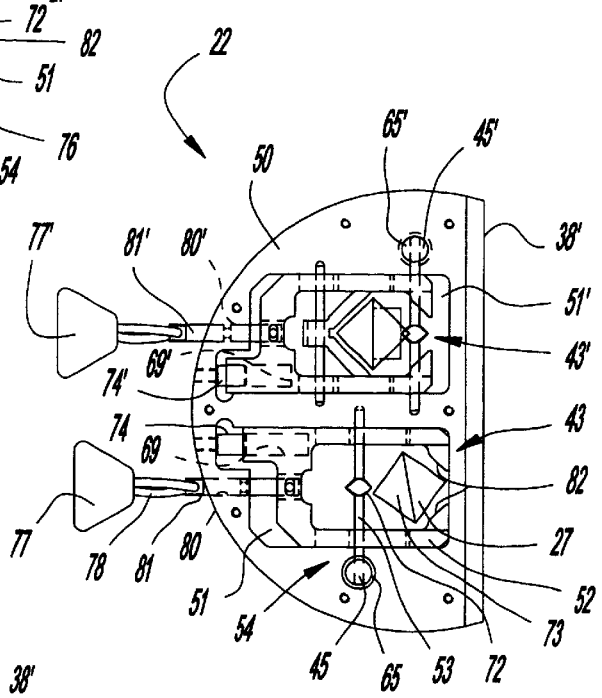
Figure 7A:
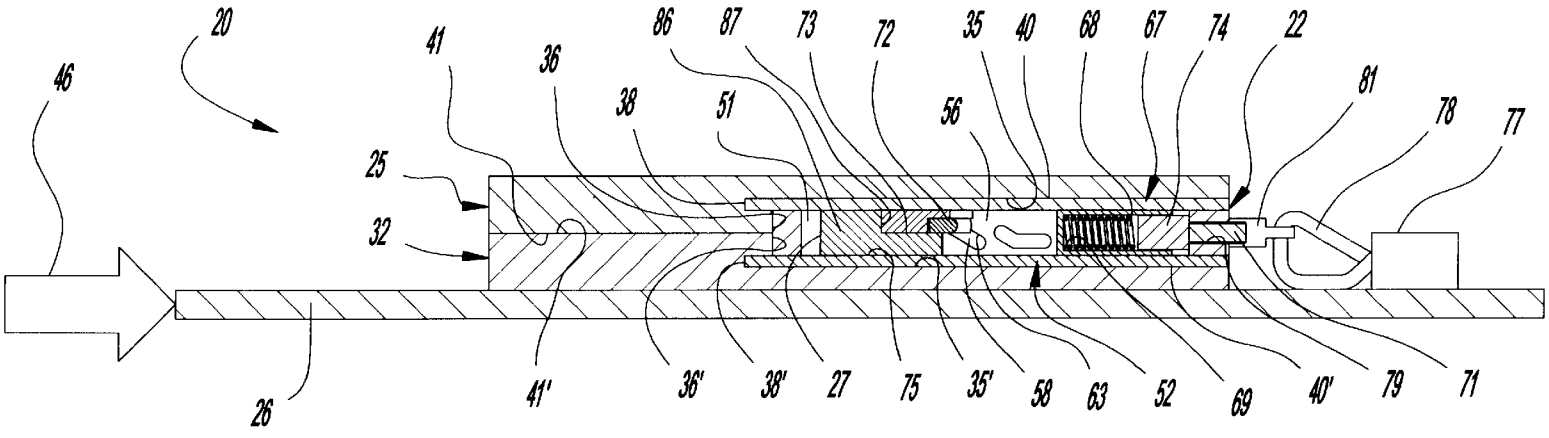
FIGS. 7A–7C is a series of side elevation views corresponding to operation of the first latch mechanism taken substantially along the planes of the line 7A–7A, 7B–7B and 7C–7C, respectively, of FIGS. 6A–6C.
Figure 7B:
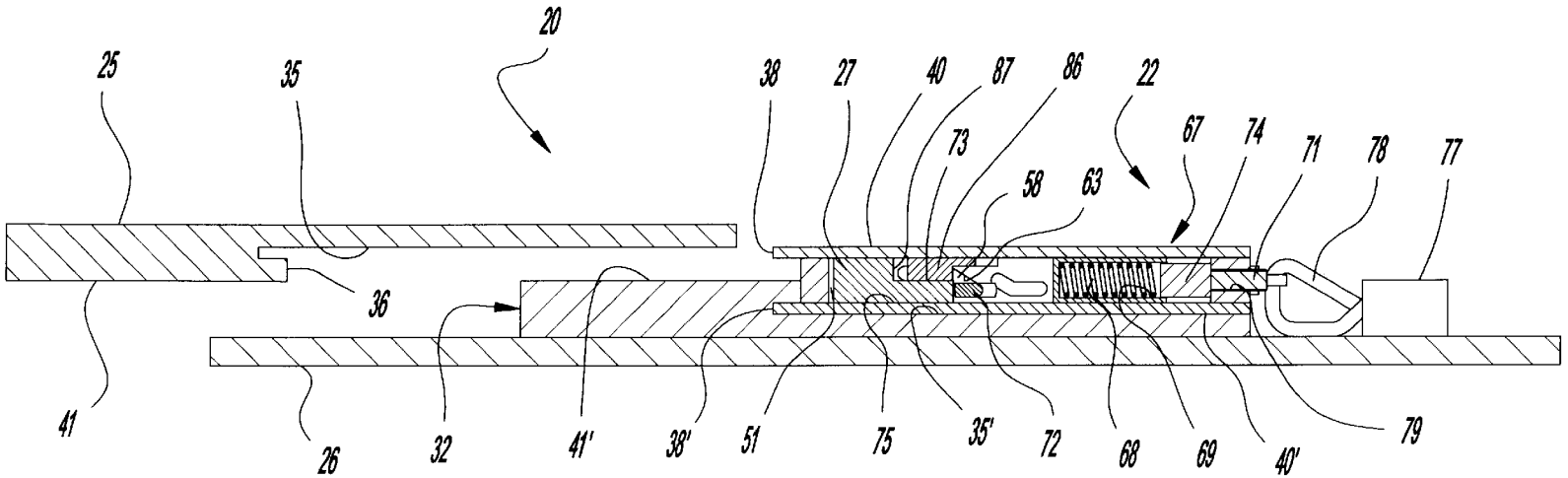

FIG. 4 best illustrates that first latch mechanism 43 includes a cam assembly 54 operably coupled between the inertia block 27 and the latch member 45, which is formed to urge the latch member 45 vertically between the latch position (FIGS. 5A, 6A and 7A) and the unlatched position (FIGS. 5B, 6B and 7B). Cam assembly 54 includes a U-shaped lever member 52 adapted for sliding reciprocal movement in first cavity 51 between a first position (FIGS. 5A, 6A and 7A) and a second position (FIGS. 5B, 6B and 7B), relative housing 50. Lever member 52 includes a pair of spaced-apart leg portions (55 and 56) positioned on opposed sides of inertia block 27. Each leg portion provides opposed dowel slots 57 and 58 extending longitudinally therealong and formed for sliding receipt of a dowel pin 53 extending laterally across the spaced-apart leg portions 55 and 56, as the lever member slidably moves between the first and second positions.

The distal ends of dowel pin 53 are slidably supported in vertically extending grooves 60, 61 (FIGS. 4 and 6) formed in opposed sides of first cavity 51 of housing 50. Accordingly, as lever member 52 moves relative housing 50 between the first position and the second position, dowel pin 53 is prevented from moving horizontally relative housing 50 due to the ends of dowel pin 53 being slidably received in vertical grooves 60, 61. However, as will be described in greater detail below, dowel pin 53 is coupled to latch member 45 in a manner enabling vertical movement between the latched and unlatched position.

In the preferred form, each opposed dowel slot 57, 58 includes a ramped portion 62, 63 which is skewed downwardly at about 20 degrees to about 45 degrees, and more preferably 30 degrees, relative the horizontally extending leg portions 55, 56 of the lever member 52. When lever member 52 moves in cavity 51 from the first position (FIGS. 5A, 6A and 7A) to the second position (FIGS. 5B, 6B and 7B), each downward ramped portion 62, 63 causes dowel pin 53, in cam contact therewith, to move vertically along vertical groove 60, 61. In turn, latch member 45, mounted to one end of dowel pin 53, is caused to move from the latched position to the unlatched position, withdrawing the end of latch member 45 from locking contact with receiving bore 48. As a result, as shown in FIG. 3B, boot plate is permitted to separate from latch assembly 22. More concisely, as lever member 52 is caused to slidably move horizontally in cavity 51 between the first position and the second position, latch member 45 is caused to move vertically between the latched position and the unlatched position (via, dowel pin 53 and dowel slots 57, 58). It will be appreciated that the angle of declination of the ramped portions may vary depending upon the desired vertical displacement of the dowel pin relative the horizontal displacement of the lever member.

Further, latch member 45 is preferably provided by a cylindrical pin slidably received in a vertical recess 65 formed in housing 50. During movement of latch member 45 to the unlatched position (FIGS. 5B, 6B and 7B), the latch member is retracted into recess 65. An O-ring washer 66 is provided, as best viewed in FIG. 4, mounted to the latch member 45 for sliding contact with the cylindrical interior walls defining recess 65. This O-ring washer 66 provides a watertight seal to prevent moisture from entering the first and second cavities 51, 51'.

Figure 7C:
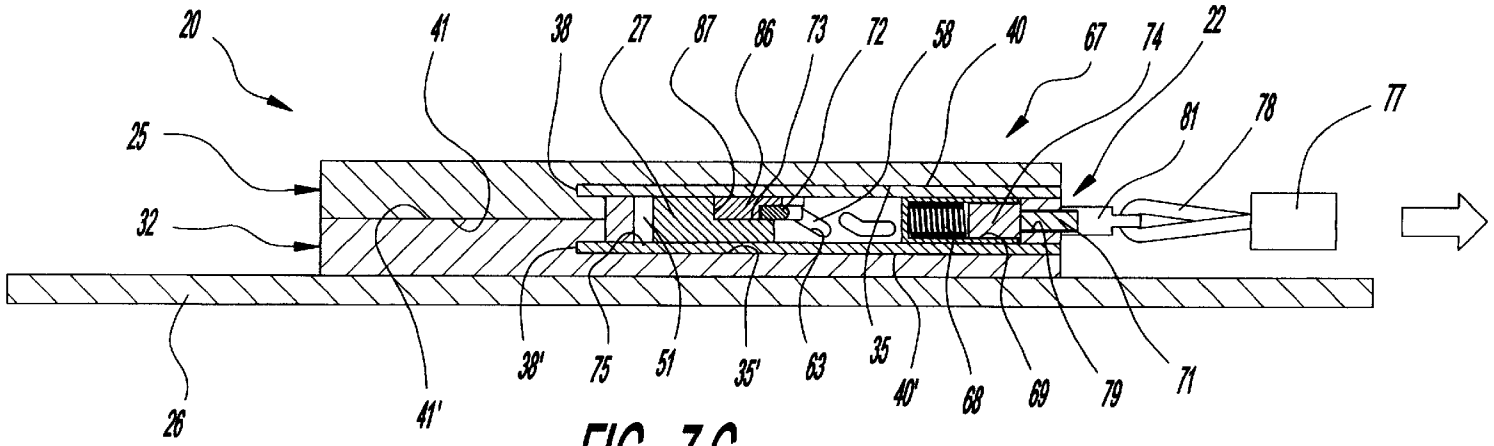

To facilitate movement of the lever member toward the second position, when inertia block 27 is removed from supportive contact with first latch mechanism 43, a biasing device 67 is provided operably coupled to the first latch mechanism 43. The biasing device 67 biases the latch assembly toward the unlatched position, and is preferably provided by a compression spring 68 slidably housed in a bore 69 (FIG. 7) extending into a neck portion 70 protruding outwardly from lever member 52. One end of compression spring 68 abuts a rear interior wall of bore 69 while an opposite end thereof contacts a cylindrical spacer 74 slidably received in the opening into bore 69. As shown in FIGS. 4 and 7, the opposite end of spacer 74 contacts a set screw 71 threadably mounted in an aperture 79 in housing 50. Set screw 71, hence, can be manipulated to threadably adjust the compression force applied to lever member 52 by spring 68.

In accordance with the present invention and as set forth above, inertia block 27 is positioned in supportive contact with first latch mechanism 43 to supportably retain the latch member 45 in the latched position. FIGS. 4, 6 and 7 best illustrate that dowel pin 53 includes a support portion 72 positioned between spaced-apart leg portions 55, 56 and formed for supportive contact with an opposed shoulder portion 73 of the inertial block 27, in the latched position. Inertia block 27, which is movable between a support position (FIGS. 5A, 6A and 7A) and a release position (FIGS. 5B, 6B and 7B), is preferably positioned between the spaced-apart leg portions 55, 56. In the support position, the inertial block supportably retains the dowel pin 53, and hence, latch member 45, vertically in the latched position, while in the released position, the shoulder portion 73 of the inertia block is out of supportive contact with the support portion 72 of dowel pin 53. Accordingly, in the released position, the biasing device 67 urges the lever member 52 toward the second position, and hence latch member to the unlatched position.

Figure 8:
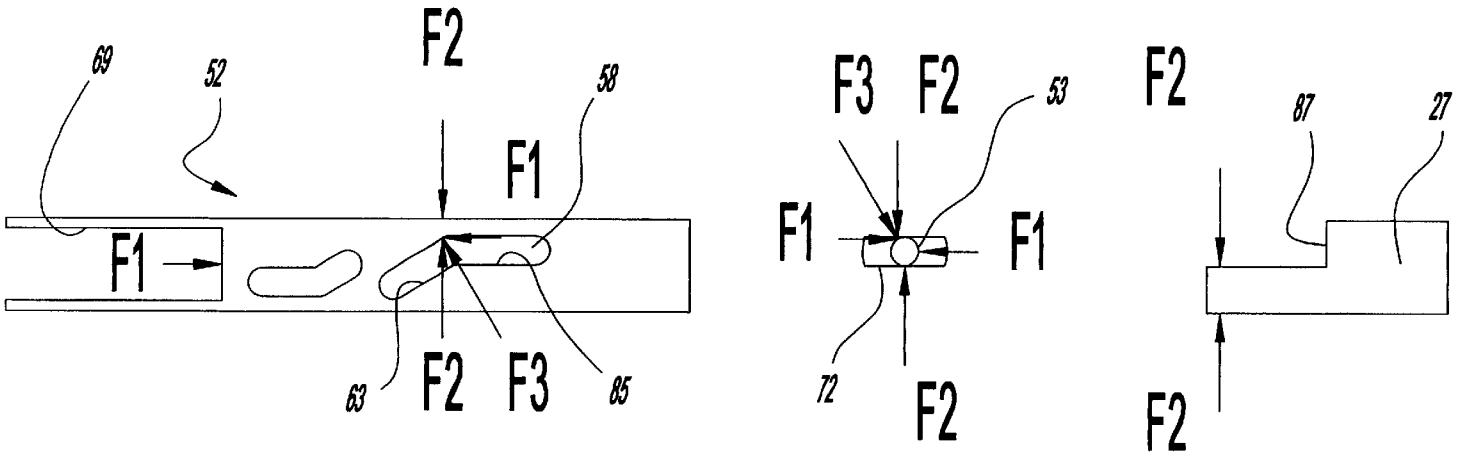
FIG. 8 is a schematic of the forces exerted upon the components of the latch assembly.

FIGS. 5A and 7A illustrate that in the latched position, dowel pin 53 is frictionally supported atop inertia block 27. As biasing device 67 urges lever member 52 toward the second position, the interior walls defining the ramped portion 62, 63 of dowel slots 57, 58 contact the dowel pin and cause a downward vertical force (F2 in FIG. 8) upon inertia block 27 to frictionally wedge the same between the support portion 72 of dowel pin 53 and the floor 75 of housing 50. The equilibrium of forces are best viewed in the schematic of FIG. 8 for lever member 52, dowel pin 53 and inertia block 27. The horizontal force (F1) represents the compression force of compression spring 68 biasing lever member 52 toward the second position. Since the ramped portions 62, 63 of dowel slots 57, 58 are not parallel to the axis of compression spring 68, the resulting contact force (F3) between lever member 52 and dowel pin 53 includes a vertical component (F2). This vertical component (F2) is the contact force between dowel pin 53 the shoulder portion 73 of inertia block 27. Accordingly, by manipulating the preload of spring 68, via turning set screw 71, the contact force (F2) between inertia block 27 and the first cavity floor 75 can be adjusted. For example, the greater the contact force, the greater the impact force must be to overcome the frictional contact between the inertia block 27 and the cavity floor 75 before the inertia block becomes dislodged. The weight of the snowboarder, thus, has no direct influence on the dislodging of the inertia block.

Accordingly, the inertial block 27 remains positioned in the support position until the binding assembly 20 is subject to an impact which includes a horizontal component of a sufficient direction and of a sufficient magnitude to overcome the frictional force (F1 in FIG. 8) retaining inertia block 27 in the support position. This frictional force, of course, is primarily a function of the sum of the downward force (F2) and the weight of the inertia block, and the coefficient of friction $\mu$ between the first cavity floor 75 and the bottom surface of the inertia block, preferably between about 0.05 to about 0.25.

Upon dislodging the inertia block from the support position (FIGS. 5A, 6A and 7A) to the release position (FIGS. 5B, 6B and 7B), biasing device 67 urges the lever member from the first position to the second position. As the lever member moves horizontally to the second position, the ramped portions 62, 63 of dowel slots 57, 58 cause the dowel pin to move vertically downwardly in vertical grooves 60, 61 which in turn moves the latch member from the latched position to the unlatched position. Subsequently, the boot plate 25 can be separated from the latch assembly/base plate combination to release the snowboarder from the snowboard.

Once the latch assembly 22 has been released (i.e., movement of the latch assembly 22 from the latch position to the unlatched position), the binding assembly 20 may be easily reset by activating a reset mechanism 76 included in latch assembly. First, the boot plate 25 (or base plate 32) must be reassembled with the latch assembly, as shown in FIG. 3A. Initially, the contact surface 35 of the boot plate 25 is positioned in supportive contact with the opposed contact surface 40 of latch assembly 22, while the support surface 41 of the boot plate is positioned in supportive contact with the opposed support surface 42 of base plate 32. Subsequently, the lip portion 36 of the boot plate is interlocked with the opposed lip portion 36 of latch assembly, and the peripheral surfaces of the boot plate and the latch assembly/base plate combination are aligned with one another (FIG. 3A).

Reset mechanism 76 is then actuated through the manual operation of knob 77 which can be manipulated and is accessible from outside the latch assembly. Reset mechanism 76 operably repositions inertia block 27 back into supportive contact with the opposed support portion 72 of dowel pin 53. In turn, latch member or pin 45 is forced or urged from the unlatched position back to the latch position where the distal end of latch pin 45 is received in bore 48.

Referring back to FIG. 4, reset mechanism 76 is shown in detail including a reset pin 81 having one end coupled to knob 77 through cord 78, and an opposite end coupled to lever member 52. Housing 50 provides an aperture 80 extending into first cavity 51 for sliding receipt of reset pin 81 therethrough as lever member 52 is pulled from the second position (FIGS. 5B, 6B and 7B) to the first position (FIGS. 5A, 6A and 7A). To reset the inertia block in supportive contact under the support portion 72 of dowel pin 53, the reset pin 81 is further pulled, via knob 77, axially therealong pulling the lever member 52 in a direction toward and beyond the first position to a reset position (FIGS. 5C, 6C and 7C) in cavity 51.

Figure 6C:
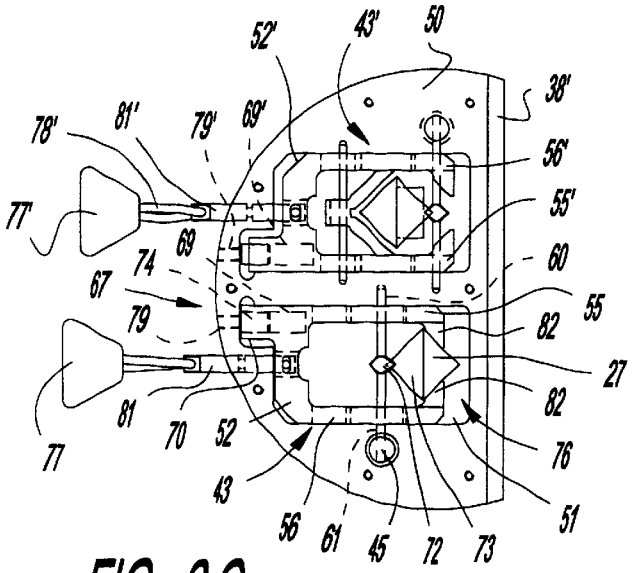

As shown in FIG. 6, reset mechanism 76 includes a reset pusher 82 configured to contact inertia block 27, when lever member 52 is moved to the reset position, to for movement thereof from the release position (FIG. 6B) to the support position (FIG. 6A). The first latch assembly 22, in the preferred form, provides a pair of opposed reset pushers 82 each extending into the space provided between the spaced-apart leg portions 55, 56. Each reset pusher 82 is triangular-shaped, and is positioned proximate the distal ends of leg portions 55, 56 of lever member 52 such that the inertia block 27 is situated between the reset pushers 82 and the dowel pin 53. Upon manipulation of reset pin 81 to move the lever member 52 from the second position to the reset position, the reset pushers contact the respective back walls of the inertia block. As the lever member is moved to the reset position (FIG. 6C), the inertia block is reoriented and moved to the proper position for support of the dowel pin thereon (i.e., the support position as shown in FIGS. 6A and 6C).

Once the lever member is urged from the second position to the first position, the walls defining dowel slots 57, 58 urge dowel pin 53, which is horizontally restrained by vertical grooves 60, 61, upwardly to the top of the ramped portion 62, 63. Latch member 45, hence, will be moved from the unlatched position to the latched position. Further, at this position, the support portion 72 of dowel pin 53 is sufficiently vertically repositioned to enable inertia block to be positioned in supportive contact atop the shoulder portion 73 of the inertia block. However, the reset pusher 82 must further position inertia block 27 under the support portion of dowel pin 53 for supportive contact therewith. Accordingly, as shown in FIGS. 4, 5C, 7C and 8, each dowel slots 57, 58 includes a reset portion 83, 85 oriented at the top of ramped portion 62, 63 and extending rearwardly therefrom toward the reset pusher 82. These horizontally extending reset portions 83, 85 of dowel slots 57, 58 enable dowel pin 53 to be retained at this vertical position while the reset pusher 82 urges inertia block 27 under the support portion of dowel pin 53. As lever member 52 is moved to the reset position (FIGS. 5C, 6C and 7C), reset pusher 82 urges the lever member to the support position until a contact wall 87 of inertia block 27 contacts a stop member 86 mounted to the ceiling surface 88 of top plate 90 of housing 50.

As lever member 52 is moved from the released position to the reset position, via knob 77, biasing device 67 is forcibly compressed. Upon manual release of knob 77, compressed spring 68 urges lever member 52 from the reset position back to the first position (FIGS. 5A, 6A and 7A) until sliding movement of lever member 52 is prevented as the dowel pin contacts the top interior walls of ramped portions 62, 63, and the support portion 72 of dowel pin 53 vertically and frictionally seats atop the shoulder portion 73 of inertia block 27. Thus, the latch member is retained in the latched position, the lever member in the first position and the inertia block in the support position.

An O-ring washer 89 (FIG. 4) is provided mounted to the reset pin 81 for sliding contact with the cylindrical interior walls defining aperture 80. This O-ring washer 89 provides a watertight seal with the aperture to prevent moisture from entering the first and second cavities 51, 51'.

As set forth above, the first latch mechanism 43 enables separation of boot plate 25 from the latch assembly/base plate combination for impacts experienced by the latch assembly in directions about 0° to about 180° relative vertical plane 33 extending through the binding assembly (FIG. 3B). Second latch mechanism 43', on the other hand, enables separation of the boot plate/latch assembly combination from the base plate for impacts experienced by the latch assembly in directions about 180° to about 360° relative the vertical plane 33 (FIG. 3C).

Figure 9A:
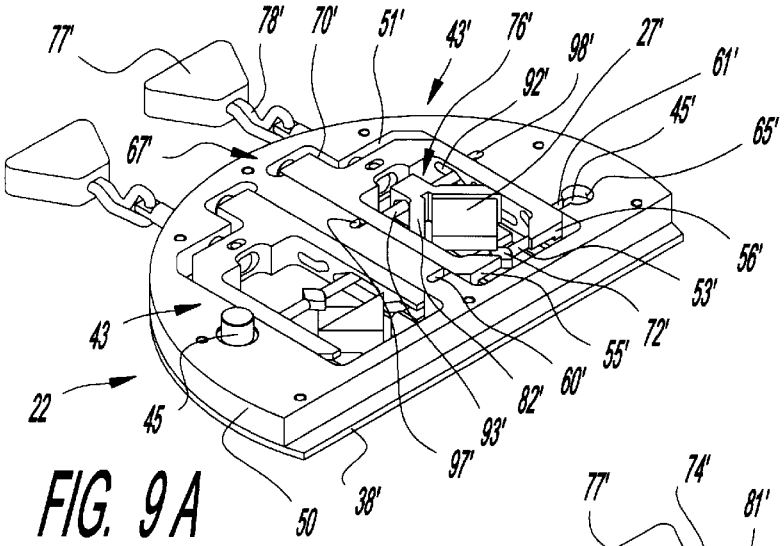
FIGS. 9A–9C is a series of top perspective views of the binding assembly of FIG. 1 illustrating operation of the second latch mechanism.

While second latch assembly 22' is essentially the mirror image of first latch assembly 22, as best viewed in FIGS. 4, 9 and 10, there are a few distinct differences which will be described in detail henceforth. For example, although movement of the second inertia block 27' from the support condition (FIGS. 9A, 10A) to the release condition (FIGS. 9B, 10B) occurs in directions opposite that of the first inertia block 27 (i.e., to accommodate impact forces from about 180° to about 360°), sliding movement of the second lever member 52' from the first condition to the second condition occurs in the same direction as that of the first lever member 52.

Further, movement of the second latch member 45' from the latched condition (FIGS. 9A, 10A) to the unlatched condition (FIGS. 9B, 10B) occurs in a direction opposite that of the first latch member 45 to enable separation of the lower base plate 32 from the latch assembly/boot plate combination (FIG. 3C). To accommodate these direction changes, the second dowel slots 57', 58'of second lever member 52' extend in an opposite orientation as the dowel slots 57, 58 of first lever member 52. FIG. 4 illustrates that the ramped portions 62', 63'of second dowel slots 57', 58' are configured and oriented to direct and urge the second dowel pin 53' and second latch member 45' in a direction opposite that of the first latch member 45 as the second latch member moves from the latched condition to the unlatched condition.

Further, the second reset pusher 82' of second reset mechanism 76' is positioned on an opposite side of second inertia block 27', in contrast to the first reset pusher 82. Since the second inertia block 27' slidably moves in the direction opposite the first inertia block 27, upon movement from the support condition (FIGS. 9A, 10A) to the released condition (FIGS. 9B, 10B), the second reset pusher 82' must move in the direction opposite that of second lever member 52' during movement from the second condition (FIGS. 9B, 10B) to the reset condition (FIGS. 9C, 10C). Another significant difference, as best illustrated in FIG. 4, is that the second reset pusher 82' is independent of the second lever member 52', unlike the first latch mechanism 43.

Each leg portion 55', 56' of second lever member 52' further includes opposed reset slots 91', 92' extending longitudinally therealong, and formed for sliding receipt of a reset rod 93' extending laterally across the spaced-apart leg portions. Reset rod 93' is positioned through a slanted slot 95' extending through a neck portion 96' in this Y-shaped second reset pusher 82' for sliding support thereon. Similar to the first and second dowel pins 53, 53', the distal ends of reset rod 93' are slidably supported in vertically extending rod slots 97', 98' formed in opposed sides of second cavity 51' of housing 50. Accordingly, as the second lever member 52' moves between the second condition and the reset condition, reset rod 93' is prevented from moving horizontally relative housing 50 due to the ends of reset rod 93' being slidably received in vertical rod slots 97', 98'.

Figure 9B:
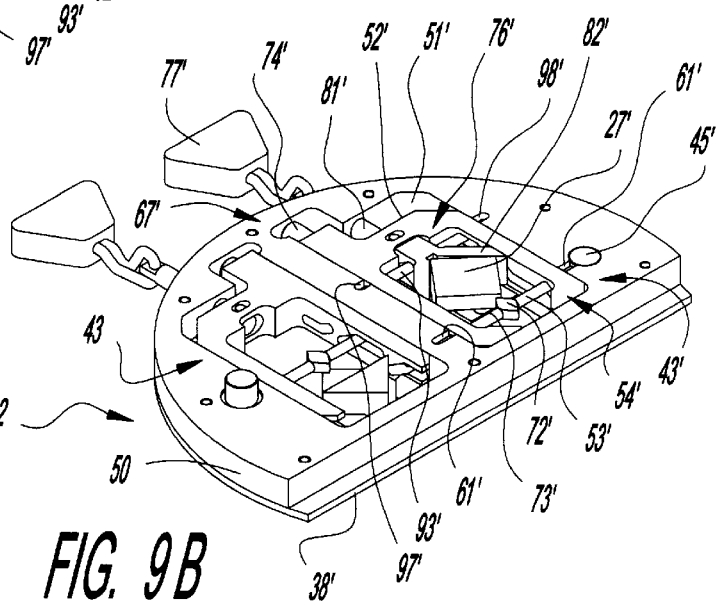
Figure 9C:
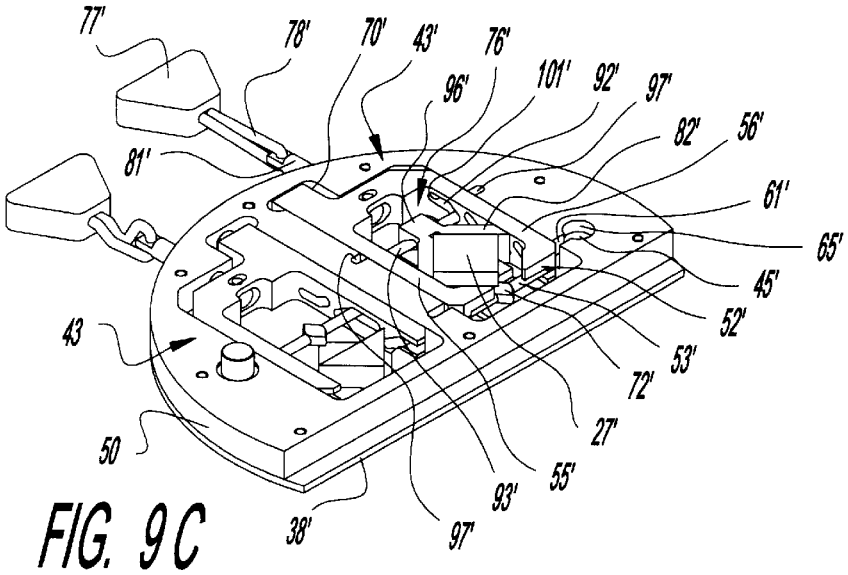
Figure 10A:
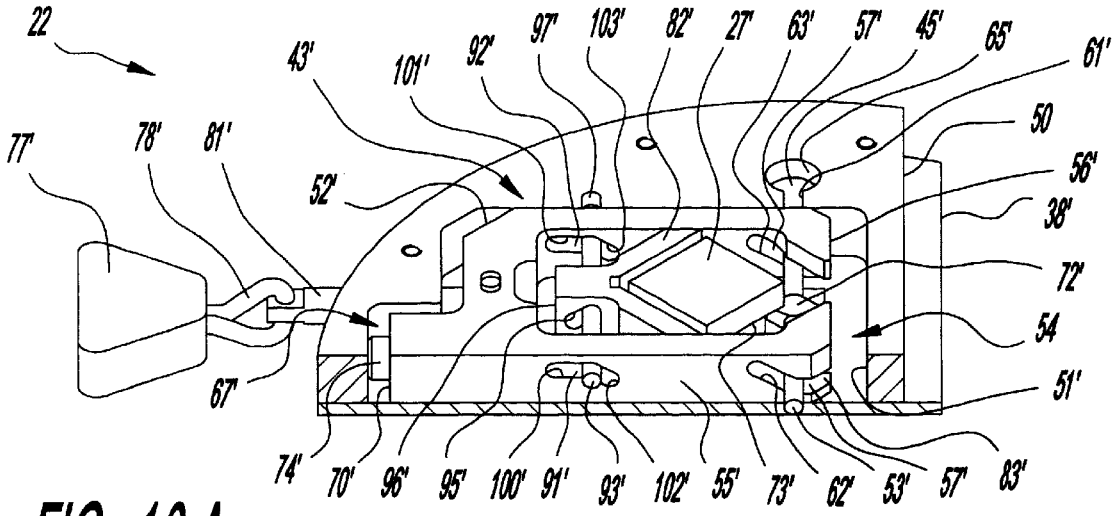
FIGS. 10A–10C is a series of top plan views corresponding to operation of the second latch mechanism of FIGS. 9A–9C.
Figure 10B:
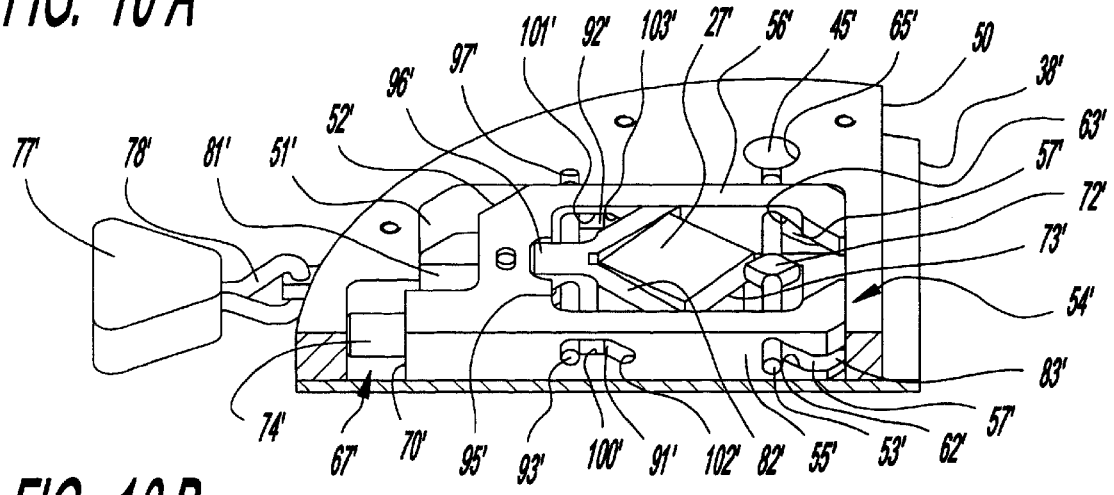
Figure 10C:
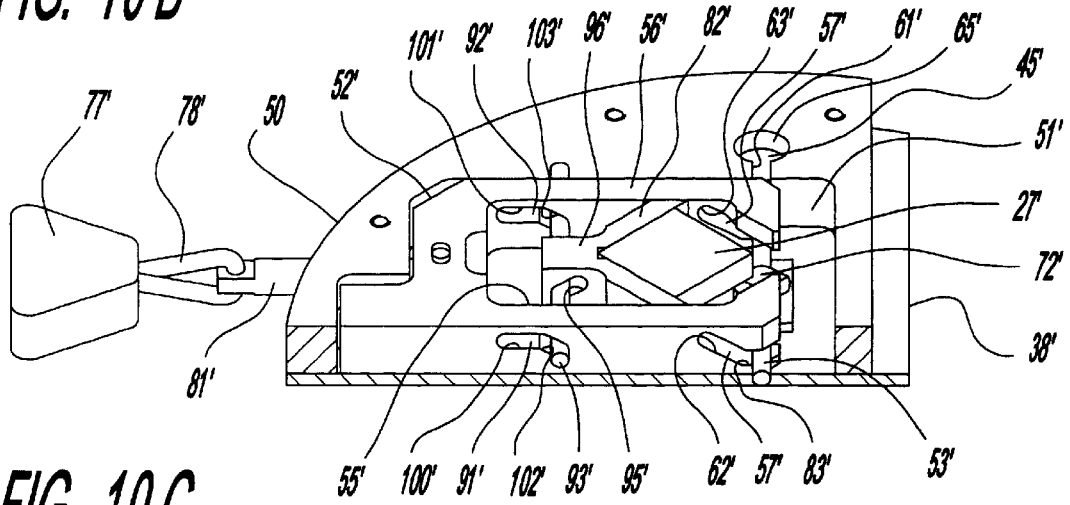

FIG. 10B best illustrates that reset slots 91', 92' of second lever member 52 includes a horizontal portion 100', 101 ' formed for sliding receipt of reset rod 93' therein as the second lever member moves between the first condition (FIGS. 9A, 10A) and the second condition (FIGS. 9B, 10B). Reset slots 91', 92' further include a slanted portion 102', 103' slanted downwardly and formed to urge the reset rod downwardly in the vertical rod slots 97', 98', when the second lever member 52' is manually moved (via, knob 77') from the first condition (FIGS. 9A, 10A) to the reset condition (FIGS. 9C, 10C). Incidentally, it will be appreciated that the second lever member must first be manually moved from the second condition to the first condition.

To move the second reset pusher 82' into contact with second inertia block 27', in the reset position, the slanted slot 93' is oriented in a direction downwardly and away from the second inertia block 27'. Accordingly, as the reset rod 93' is forced downwardly, via the slanted portions 102', 103' of reset slots 91', 92', during manual movement of the second lever member 52' toward the reset condition (FIG. 10C), the reset rod 93' is urged downwardly in slanted slot 95'. In turn, reset pusher 82' is urged toward and into contact with the second inertia block 27', via cam contact with downwardly displacing reset rod, for positioning into supportive contact with second dowel pin 53'.

Similar to the first latch assembly, upon manual release of second knob 77', the second biasing device 67' urges the second lever member 52' from the reset condition (FIG. 9C, 10C) back toward the first condition ( FIGS. 9A, 10A) until sliding movement thereof is prevented when the second dowel pin 53' contacts the upper interior walls of the second ramped portions 62', 63' of second dowel slots 57', 58'. Moreover, the support portion 72' of second dowel pin 53' vertically and frictionally seats atop the shoulder portion 73' of second inertia block 27'.

Moreover, second reset pusher 82' is retracted away from contact with second inertia block, via cammed contact between reset rod 93', reset slots 91', 92' and slanted slot 95' during movement of the second lever member 52' from the reset condition to the first condition.

Figure 11:
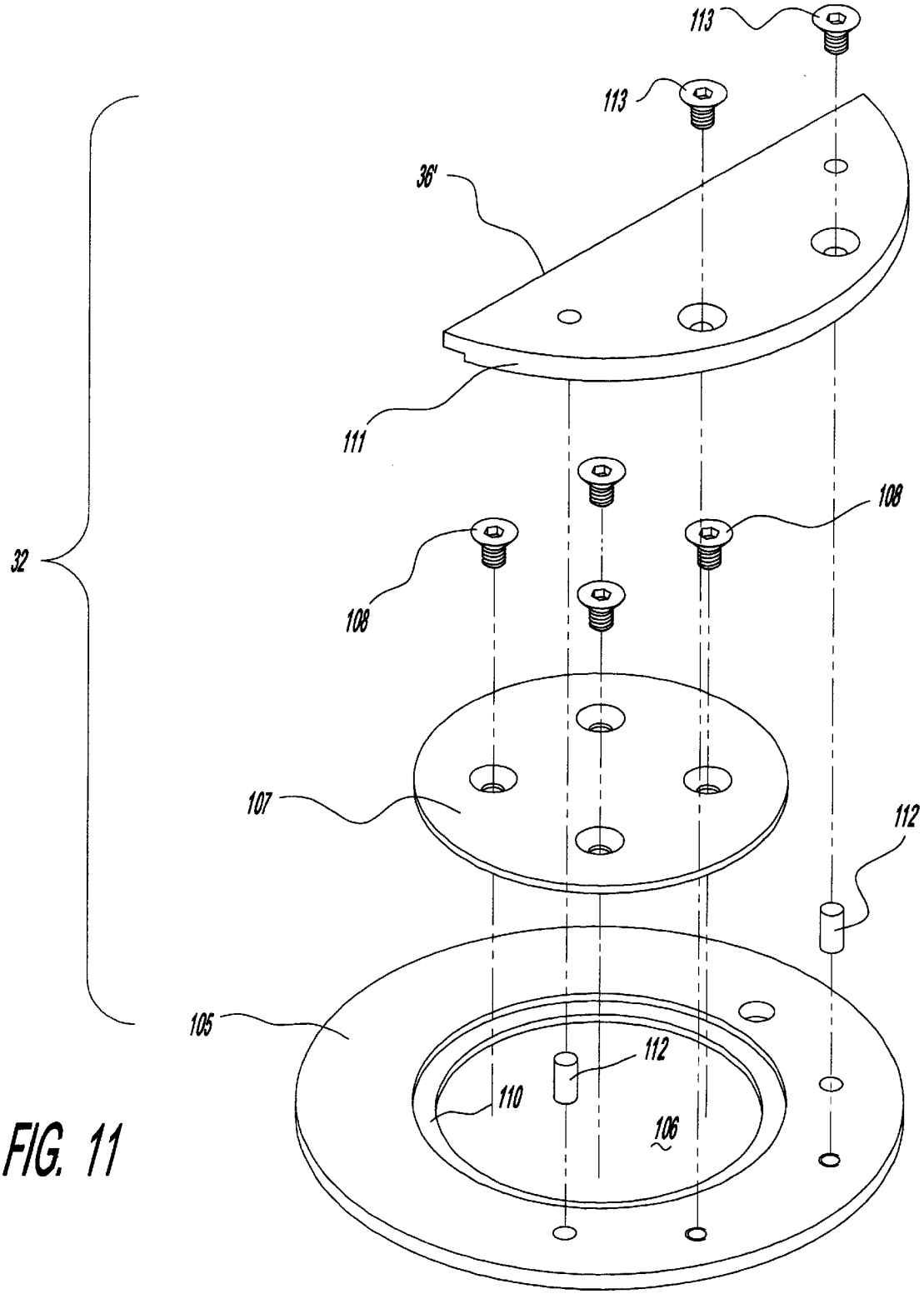
FIG. 11 is an exploded top perspective view of a base plate of the binding assembly of FIG. 1.

Turning now to FIG. 11, the lower base plate 32 is illustrated including an outer base ring 105 defining a mounting port 106, and a mounting plate 107 formed for concentric rotational receipt the base ring 105. The mounting plate includes a plurality of holes formed for receipt of fasteners 108 extending therethrough for mounting to the top surface of the snowboard. Base ring 105 further includes an annular lip portion 110 formed for rotational sliding support of mounting plate 107 thereon. Accordingly, base ring 105, in supportive contact with mounting plate 107, can be rotated about a longitudinal axis thereof to adjust the orientation of the opposed lip portion 36' of the latch assembly relative the snowboard. As a result, the snowboarder can customize their boot position as desired. Upon proper orientation of the base ring 105 about the mounting plate longitudinal axis, the fastening devices, preferably screws, can be tightened to anchor the mounting plate, and hence, the base ring 105 to the snowboard.

The opposed lip portion 36' is preferably provided by a semi-circular lower center plate 111 formed for mounting to the base ring 105. A set of alignment pins 112 are included which are positioned through the corresponding apertures in center plate 111 and base ring 105. Hence, when the opposed lip portions of latch assembly 22 is interlock with the opposed lip portion of the center plate 111, the alignment pins 112 and fasteners 113 prevent separation of the center plate from the base ring.

Figure 12:
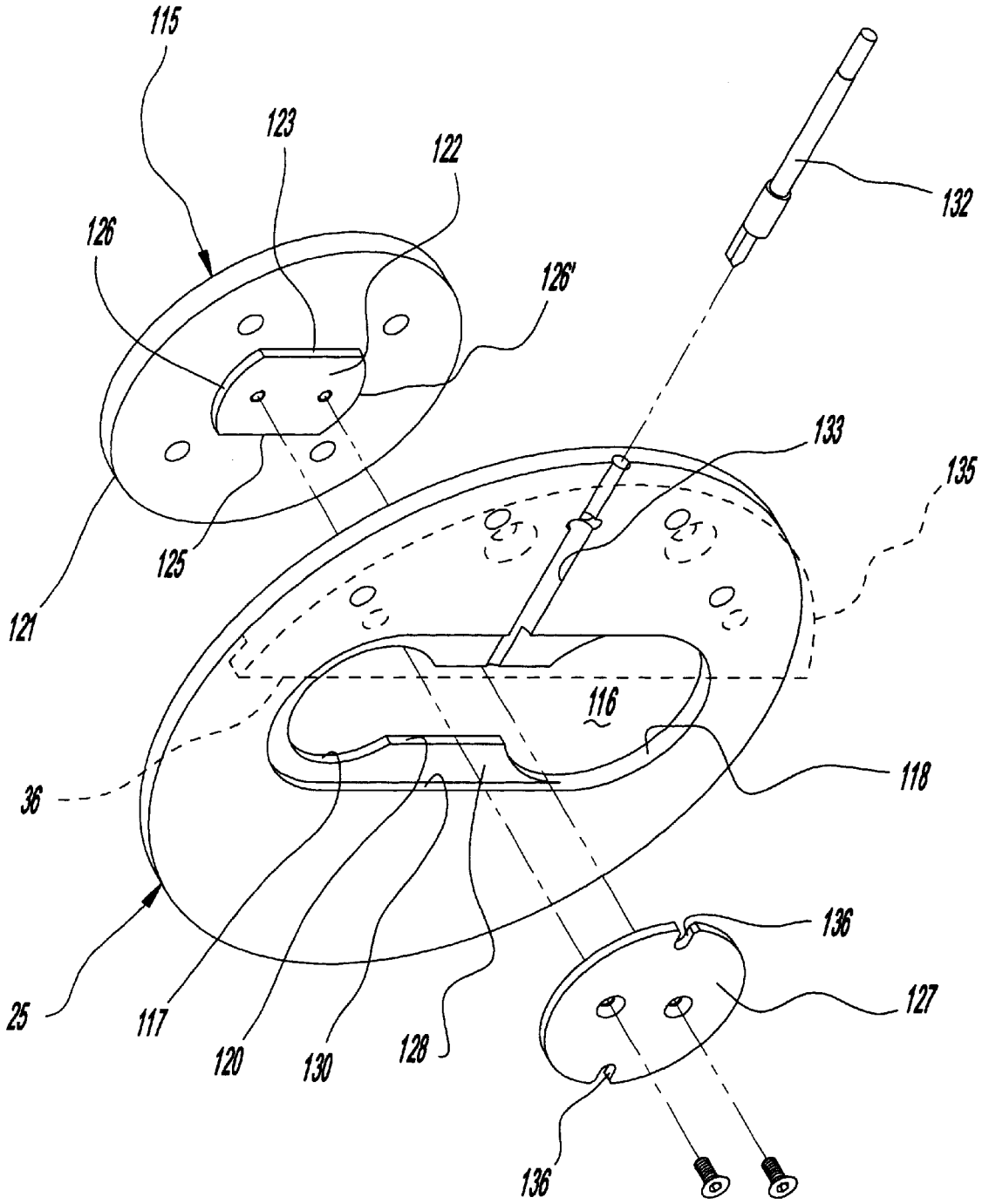
FIG. 12 is an exploded bottom perspective view of an alternative embodiment adjustable position boot plate of the binding assembly of FIG. 1.
Figure 13C:
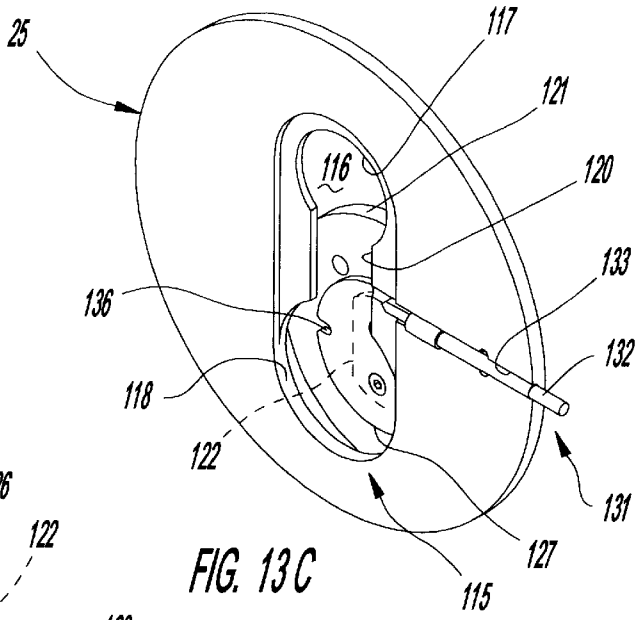
FIGS. 13A–13C is a series of bottom perspective views of the adjustable position boot plate of FIG. 12 and illustrating operation of the thereof.

FIGS. 12 and 13 best illustrate an alternative embodiment of boot plate 25 which includes a foot plate assembly 115 formed to cooperate with an adjustment slot 116 of boot plate 25 for selective relative movement and separation therebetween. Thus, the foot plate assembly 115 may be mounted directly to the bottom of a boot (not shown) or to the bottom surface of the conventional boot strap fixture 30 of FIG. 2, either of which enables releasable mounting to the boot plate. As shown in FIG. 12, adjustment slot 116 transverses a portion of the boot plate 25, and includes a generally circular swivel portion 117 positioned on one end of the adjustment slot 116, a generally circular release portion 118 at the opposite end thereof, and a generally rectangular locked portion 120 separating the swivel portion 117 from the release portion 118.

Figure 13B:
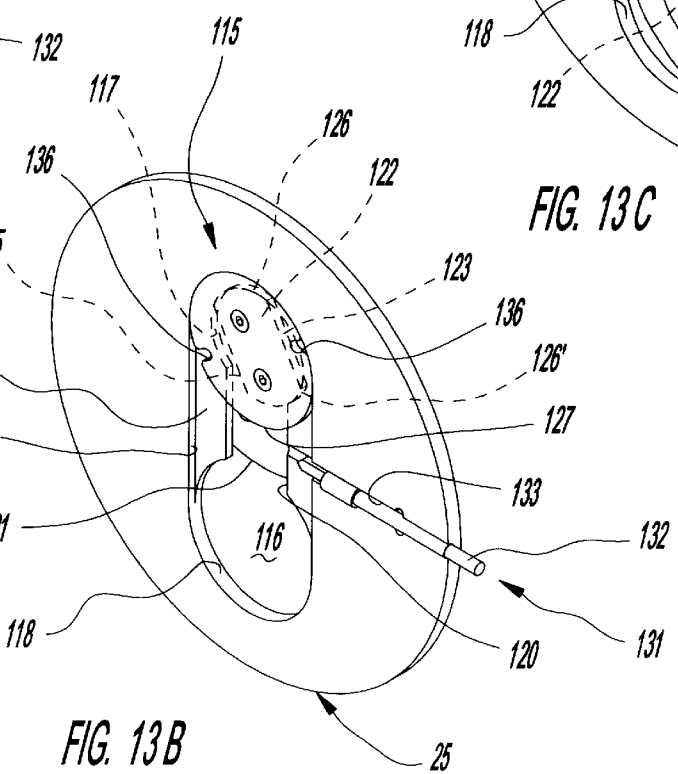

Foot plate assembly 115 includes a generally circular foot plate 121 having a key member 122 mounted to or protruding from a bottom surface thereof. Key member 122 is generally rectangular in shape having opposed, spaced-apart parallel sides 123, 125 configured for sliding receipt in the locked portion 120 (FIG. 13A), and opposed arcuate ends 126, 126' formed for rotatable receipt in swivel portion 117 (FIG. 13B). Accordingly, as shown in FIG. 13B, when key member 122 is positioned in swivel portion 117 of adjustment slot 116, mounting plate is permitted to rotate about its longitudinal axis, enabling the snowboarder to freely swivel their feet relative boot plate 25. In contrast, when the parallel sides 123, 125 of key member 122 are aligned and slidably received in the locked portion 120 of adjustment slot 116 (FIG. 13A), the mounting plate is prevented from rotating relative boot plate 25.

To prevent removal of the foot plate 121 from the boot plate 25 when the key member is positioned in either the locked portion 120 or the swivel portion, foot plate assembly 115 includes a locking plate 127 mounted to the bottom of the key member 122. FIGS. 12 and 13 best illustrate that locking plate 127 has a lateral dimension larger than both the key member and the adjustment slot at the locked portion 120 and the swivel portion 117. Hence, at these positions, when the locking plate is mounted to the key member 122 through fasteners 128, separation of the foot plate assembly 115 from the boot plate 25 is prevented.

Figure 13A:
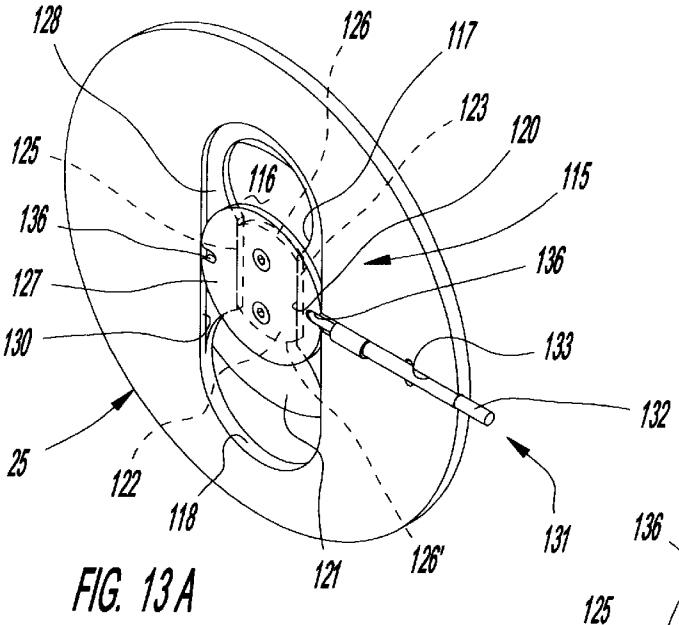

Further, to assure that the locking plate 127 will not interfere with the separation of the boot plate 25 from the latch assembly 22, when the first latch assembly is moved to the unlatched position, the locking plate 127 is seated against a ledge portion 128 of a locking plate recess 130 defined by the bottom surface of the boot plate 25. As shown in FIGS. 13A and 13B, the bottom surface of the locking plate is preferably flush with the bottom surface of the boot plate. The locking plate recess 130 is further formed for sliding receipt of locking plate from the swivel portion 117 of the adjustment slot 116 to the release portion 118 of thereof.

When the foot plate assembly is moved to the release portion 118 and past the ledge portion 128 of adjustment slot 116 (FIG. 13C), the circumferential dimension of the release portion is sufficient to enable the locking plate 127 to pass or extend therethrough. Accordingly, foot plate assembly 115 can be selectively separated from the boot plate 25.

To releasably retain the foot plate assembly 115 in a fixed position where key member 122 is received in locking portion 120 of adjustment slot 116, a locking mechanism 131 coupled between boot plate 25 and foot plate 121. Locking mechanism 131 is preferably provided by a locking pin 132 slidably received in a passage 133 formed between the boot plate 25 and the top center plate 135 (FIG. 12). This passage is oriented approximately perpendicular to the linear movement of the locking plate 127 for receipt of the distal end of the locking pin in a locking groove 136 formed in the circumferential edge of the locking plate. Hence, when the distal end of locking pin 132 is slidably received in the locking groove 136 of the locking plate, the relative rotational motion of the foot plate assembly 115 about its longitudinal axis, and linear movement of the locking plate 127 in the adjustment slot 116 is prevented.

A spring member (not shown) is provided coupled to locking pin 132 to bias the locking pin toward the adjustment slot 116. Accordingly, to withdraw the distal end of locking pin 132 from sliding receipt in locking groove 136 (FIG. 13A), the force of the spring member must be overcome by manually pulling the end of locking pin 132 outwardly. Subsequently, the foot plate assembly can be moved to the swivel portion 117 or to the release portion of the adjustment slot 116.

Figure 14:
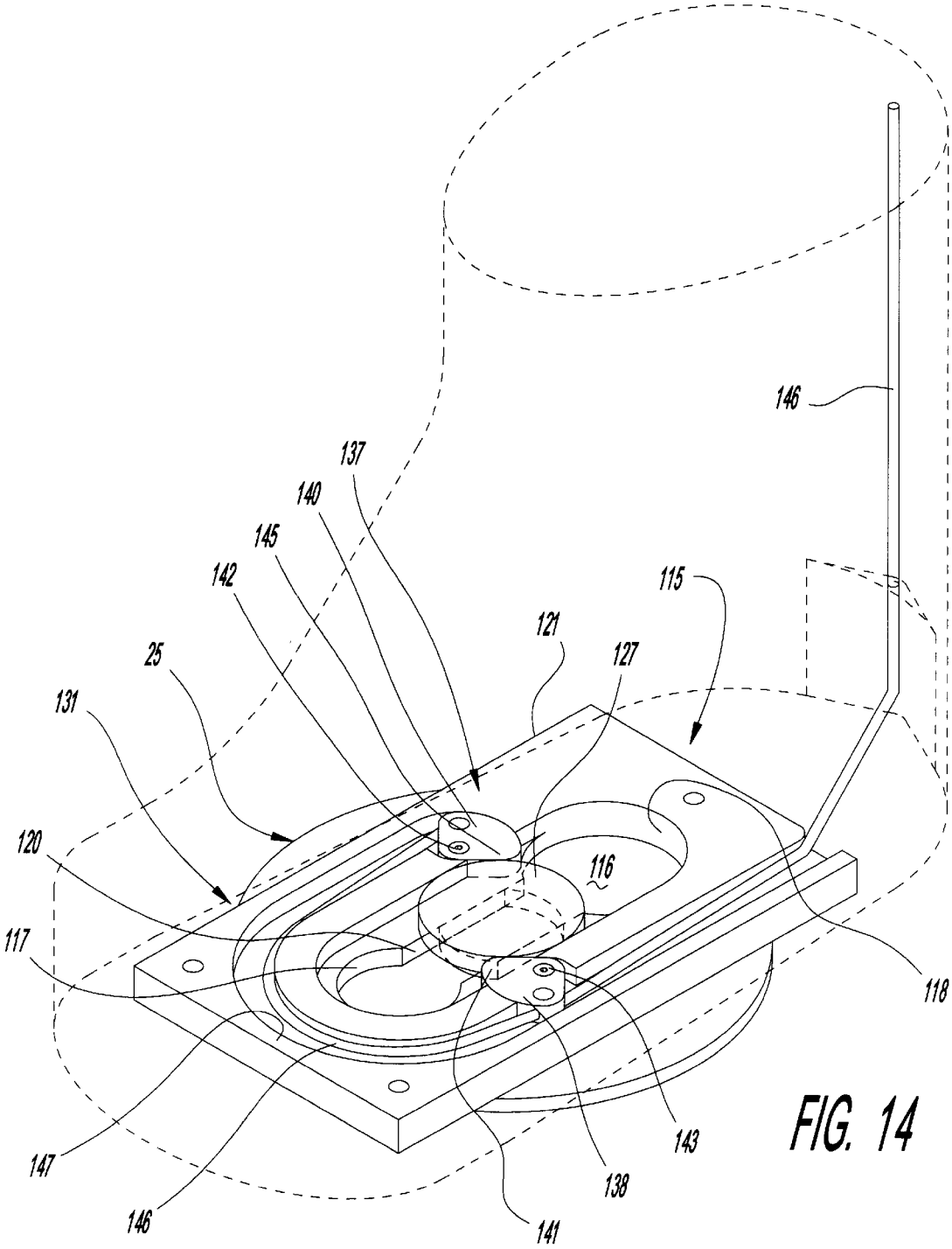
FIG. 14 is a top perspective view of an another alternative embodiment adjustable position boot plate.

As best viewed in FIG. 14, an alternative embodiment to foot plate assembly 115 is provided where foot plate 121 defines adjustment slot 116 having release portion 118, locking portion 120 and swivel portion 117. Further, boot plate 25 includes key member 122 and locking plate 127 which are formed to mate with adjustment slot 116. In this embodiment, locking mechanism 131 includes a cam mechanism 137 cooperating with locking plate 127 to mount the foot plate to the boot plate 25. It will be appreciated, however, that the locking mechanism may be provided by the locking pin embodiment shown in FIGS. 12 and 13.

Cam mechanism 137 is preferably provided by a first triangular cam member 138 and a second cam member 140 each pivotally mounted to foot plate 121 in manner positioning a respective contact portion 141, 142 thereof into adjustment slot 116 for contact with locking plate 127. Each cam member 138, 140 is selectively pivotable between a release position and a lock position (FIG. 14), locking the foot plate assembly to the boot plate at either the locked portion 120 of adjustment slot 116 or the swivel portion 117 thereof. FIG. 14 illustrates locking plate 127 positioned between the first and second cam members 138, 140 where key member 122 is positioned in the locked portion 120 of adjustment slot 116. In this configuration, foot plate assembly 115 will be retained in cam contact between the first and second cam members 138, 140 until the same are pivotally moved to the released position (not shown). Accordingly, upon pivotal movement of the cam members about respective axes 143, 145, the contact portions 141, 142 are moved sufficiently out of adjustment slot 116 and from cam contact with the respective cam members, foot plate 121 is permitted to slide linearly in adjustment slot 116 between the swivel portion, the locked portion 120 and the release portion 118.

Similarly, the foot plate assembly 115 is retained the swivel portion 117 of adjustment slot 116 through contact with the respective contact portion 141 of the first cam member 138. Upon pivotal movement of the first cam member to the release position from the lock position, the respective contact portion is pivotally withdrawn from adjustment slot 116 and out of contact with locking plate 127. Consequently, foot plate assembly 115 is capable of relative movement between the swivel portion, the locked portion 120 and the release portion 118.

To operate the locking mechanism 131 between the lock position and the release position, a cord member 146 is provided coupled to the first and second cam members 138, 140 for simultaneous manual operation thereof. Cord member 146 is operably positioned in a U-shaped groove 147 formed in foot plate 121. Upon manual pulling of cord 78 by the snowboarder, the cam members are pivotally moved to the release position (not shown). Upon release of the cord member, a biasing device, preferably provided by a torsion spring (not shown) coupled to the cam members, urges the same back toward the respective lock positions.

Figure 15:
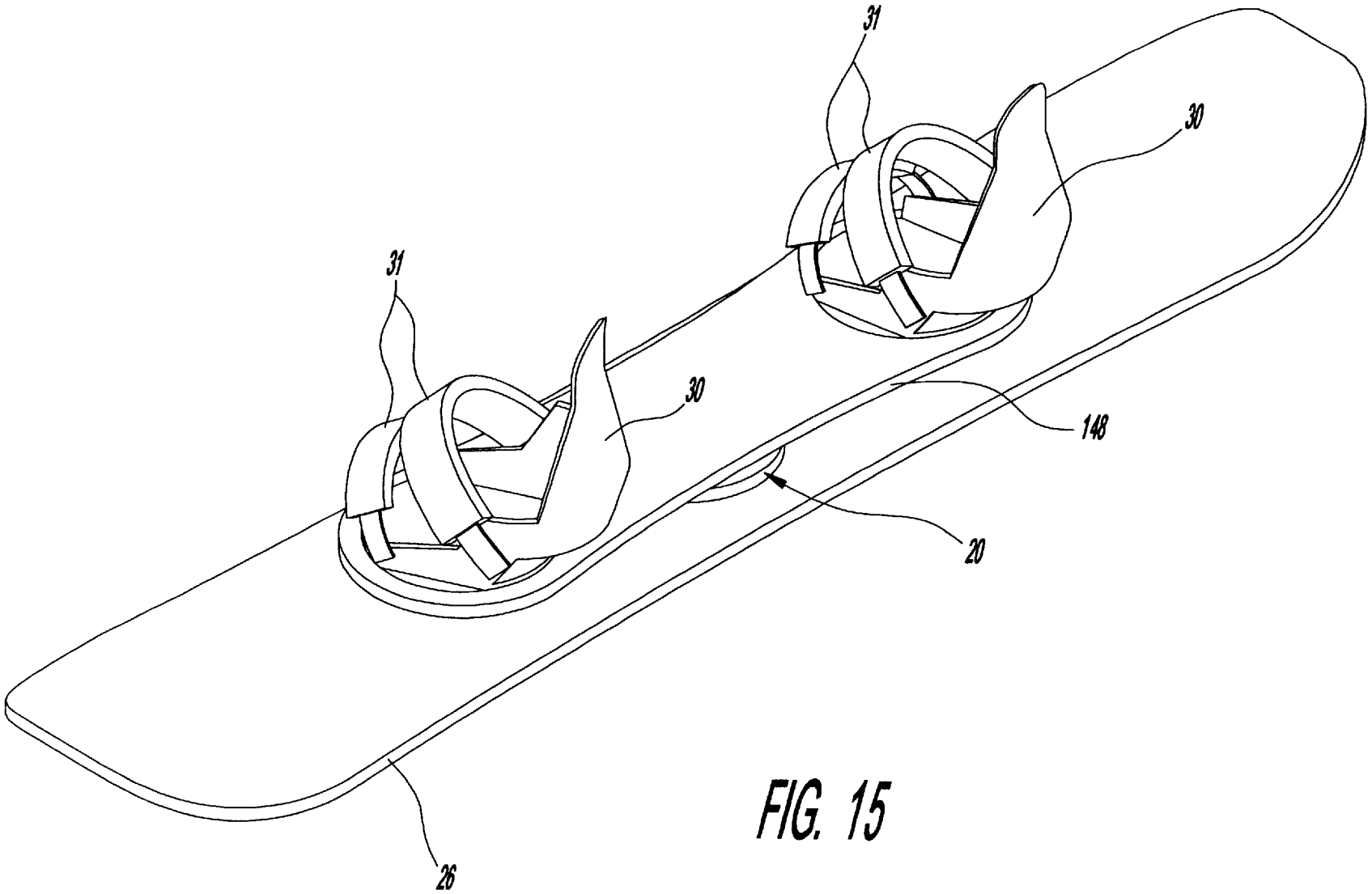
FIG. 15 is a top perspective view of an alternative embodiment snowboard binding assembly having both feet mounted to a single binding assembly.

In another embodiment of the present invention, as shown in FIG. 15, a single binding assembly 20 may be employed in the contrast to the two independent binding assemblies of FIG. 1. In this configuration, both conventional snowboard strap binding assemblies 30 are mounted to an intermediate support board 148 which, in turn, is coupled to the upper boot plate 25 of the single binding assembly 20. Accordingly, upon sufficient impact, the single binding assembly will release, thus, releasing the snowboarder from coupling to the snowboard 26.

While the present invention has been described in connection with mechanical latch mechanisms, it will be appreciated that release of the latch assemblies could be electromechanical in nature upon dislodging of the inertia block. The electronics involved would be easily constructed by those skilled in the art. Further, it will be understood that the present invention could easily be adjusted for vertical impacts, or combinations thereof, by configuring the inertia block to release in the desired impact plane.

What is claimed is:

1. A binding apparatus for impact releasably binding a boot to a snowboard, comprising:

a boot plate adapted to be coupled to the boot;

a latch assembly movable between a latched position, releasably mounting the boot plate to the snowboard, and an unlatched position, releasing the boot plate from the snowboard;

an inertia block having a selected mass and formed to retain the latch assembly in the latched position until a sufficient inertial force of at least a predetermined amount dislodges the inertia block from supportive contact with the latch assembly to cause the latch assembly to move to the unlatched position;

said latch assembly includes a latch member movable between the latched position and the unlatched position, and the boot plate defining a receiving bore formed and dimensioned for sliding receipt of the latch member to prevent relative movement between the boot plate and snowboard in the latched position, and said latch member being moved out of said receiving bore in the unlatched position enabling relative movement between the boot plate and snowboard.

2. The binding apparatus as defined in claim 1 further including:

a biasing device operably coupled to the latch assembly which biases the latch assembly toward the unlatched position.

3. The binding apparatus as defined in claim 2 wherein, said biasing device is provided by a compression spring.

4. The binding apparatus as defined in claim 1 wherein, the boot plate includes a planar contact surface and a lip portion positioned proximate an end of the contact surface;

the latch assembly includes an opposed planar contact surface formed for sliding contact with the contact surface of the boot plate, and an opposed lip portion, positioned proximate an end of the opposed contact surface thereof, formed for interlocking cooperation with the lip portion of the boot plate in an interlocking position to prevent one of vertical and twisting separation between the boot plate and the latch assembly.

5. The binding apparatus as defined in claim 1 wherein, said latch assembly further includes a cam assembly operably coupled between the inertia block and the latch member urging the latch member between the latched and unlatched position.

6. The binding apparatus as defined in claim 5 further including:

a biasing device operably coupled to the cam assembly which biases the latch member toward the unlatched position.

7. The binding apparatus as defined in claim 5 wherein, the cam assembly includes a lever member defining an elongated slot, and said latch assembly further includes a dowel pin coupled to said latch member, and slidably received in said elongated slot to urge the latch member between the latched and unlatched position.

8. The binding apparatus as defined in claim 7 further including:

a biasing device operably coupled to the cam assembly which biases the latch member and the dowel pin toward the unlatched position.

9. The binding apparatus as defined in claim 7 wherein, said dowel pin includes a support portion coupled to said inertia block to support said latch assembly in the latched position.

10. The binding apparatus as defined in claim 9 wherein, said inertia block is movable between a support position supportably retaining the latch assembly in the latched position, and a release position, releasing the latch assembly to the unlatched position in the event of said sufficient inertial force.

11. The binding apparatus as defined in claim 10 wherein, said inertia block includes a shoulder portion formed for frictional contact with the support portion of the dowel pin to frictionally maintain said inertia block in the support position until the sufficient inertial force dislodges the inertia block.

12. The binding apparatus as defined in claim 7 wherein, said latch assembly includes a housing defining a cavity formed for sliding receipt of said inertia block between a support position supportably retaining the latch assembly in the latched position, and a release position, releasing the latch assembly to the unlatched position in the event of said sufficient inertial force.

13. The binding apparatus as defined in claim 12 wherein, the housing cavity is further formed and dimensioned for sliding receipt of the lever member therein between:

a first position, corresponding to the inertia block being in the support position, and a second position, upon the inertia block moving to the release position, the dowel slot formed to urge the dowel pin and the latch member toward the unlatched position, and said latch assembly further including a biasing device operably coupled to the lever member to bias the lever member toward the second position such that the latch member is moved toward the unlatched position.

14. The binding apparatus as defined in claim 13 wherein, said lever member includes a pair of spaced-apart leg portions positioned on opposed lateral sides of the inertia block, each said leg portion defining opposed dowel slots, and said dowel pin extending laterally across said spaced-apart leg portions in the opposed dowel slots of each leg portion for relative sliding movement therealong as said lever member moves between the first and second positions.

15. The binding apparatus as defined in claim 14 wherein, each said opposed dowel slot including a ramped portion formed for urging the dowel pin and the coupled latch member between the latched and the unlatched position as said lever member moves between the first and second positions, respectively.

16. The binding apparatus as defined in claim 15 wherein, the latch housing further defines grooves on opposed sides of said cavity formed and dimensioned for sliding receipt of said dowel pin therein for movement of the latch member between the latched and unlatched positions.

17. The binding apparatus as defined in claim 13 further including:

a reset mechanism operably coupled to the lever member and said inertia block, said lever member further being movable in said cavity to a reset position to reset the inertia block in supportive contact with said dowel pin and latch member from the unlatched position to the latched position.

18. The binding apparatus as defined in claim 1 further including:

a reset mechanism operably coupled to said latch assembly and said inertia block to manually reset said latch assembly from the unlatched position to the latched position.

19. The binding apparatus as defined in claim 1 wherein, said inertia block is movable between a support position supportably retaining the latch assembly in the latched position, and a release position, releasing the latch assembly to the unlatched position in the event of at least said inertial force.

20. The binding apparatus as defined in claim 19 further including:

a reset mechanism operably coupled to said inertia block to manually reset said latch assembly from the unlatched position to the latched position and into said supportive contact therewith.

21. The binding apparatus as defined in claim 8 wherein, said biasing device is provided by a compression spring acting on said lever member.

22. A binding apparatus for impact releasably binding a boot to a snowboard, comprising:

a base plate mountable to the snowboard;

a boot plate adapted to be coupled to the boot;

a latch assembly movable between a latched position, releasably coupling the base plate to the boot plate; and an unlatched position, releasing the base plate relative to the boot plate;

an inertia block having a selected mass and movable between a support position, supportably retaining the latch assembly in the latched position, and a release position, releasing the latched assemmbly to the unlatched position upon a sufficient inertial force of at least a predetermined amount dislodges the inertia block from supportive contact with the latch assembly;

said latch assembly includes a latch member movable between the latched position and the unlatched position;

one of the boot plate and the base plate defining a receiving bore formed and dimensioned for the sliding receipt of the latch member to prevent relative movement between the boot plate and the base plate in the latched position, and said latch member being moved out of said receiving bore in the unlatched position;

said latch assembly further includes a cam assembly operably coupled between the inertia block and the latch member urging the latch member between the latched and unlatched position;

a biasing device operably coupled to the cam assembly which biases the latch member toward the unlatched position.

23. The binding apparatus as defined in claim 22 wherein, the cam assembly includes a lever member defining an elongated slot portion, and said latch assembly further includes a dowel pin coupled to said latch member, and slidably received in said elongated slot to urge the latch member between the latched and unlatched position.

24. The binding apparatus as defined in claim 23 wherein, said dowel pin includes a support portion coupled to said inertia block to support said latch assembly in the latched position.

25. The binding apparatus as defined in claim 24 wherein, said inertia block includes a shoulder portion formed for frictional contact with the support portion of the dowel pin to frictionally maintain said inertia block in the support position until the sufficient inertial force dislodges the inertia block.

26. The binding apparatus as defined in claim 23 wherein, said latch assembly includes a housing defining a cavity formed for sliding receipt of said inertia block between a support position supportably retaining the latch assembly in the latched position, and a release position, releasing the latch assembly to the unlatched position in the event of said sufficient inertial force.

27. The binding apparatus as defined in claim 26 wherein, the housing cavity is further formed and dimensioned for sliding receipt of the lever member therein between:

a first position, corresponding to the inertia block being in the support position, and a second position, upon the inertia block moving to the release position, the dowel slot formed to urge the dowel pin and the latch member toward the unlatched position, and said latch assembly further including a biasing device operably coupled to the lever member to bias the lever member toward the second position such that the latch member is moved toward the unlatched position.

28. The binding apparatus as defined in claim 27 wherein, said lever member includes a pair of spaced-apart leg portions positioned on opposed lateral sides of the inertia block, each said leg portion defining opposed dowel slots, and said dowel pin extending laterally across said spaced-apart leg portions in the opposed dowel slots of each leg portion for relative sliding movement therealong as said lever member moves between the first and second positions.

29. The binding apparatus as defined in claim 23 further including:

a reset mechanism operably coupled to lever member and said inertia block, said lever member further being movable in said cavity to a reset position to manually reset the inertia block in supportive contact with said dowel pin and latch member from the unlatched position to the latched position.

30. The binding apparatus as defined in claim 22 further including:

a reset mechanism operably coupled to said latch assembly and said inertia block to manually reset said latch assembly from the unlatched position to the latched position.

31. The binding apparatus as defined in claim 22 wherein, the boot plate includes a planar contact surface and a lip portion positioned proximate an end of the contact surface;

the latch assembly includes an opposed planar contact surface formed for sliding contact with the contact surface of the boot plate, and an opposed lip portion, positioned proximate an end of the opposed contact surface thereof, formed for interlocking cooperation with the lip portion of the boot plate in an interlocking position to prevent one of vertical and twisting separation between the boot plate and the latch assembly.

32. A binding apparatus for impact releasably binding a boot to a snowboard comprising:

a boot plate adapted to be coupled to the boot; and a latch assembly having:

a first latch mechanism inertially operable between an unlatched position, releasing the boot plate relative the snowboard, and a latched position, releasably mounting the boot plate to the snowboard until a sufficient first inertial force of at least a predetermined amount and in a direction from about 0° to about 180° relative a plane extending through the latch assembly causes the first latch mechanism to move to the unlatched position; and a second latch mechanism inertially operable between an unlatched condition, releasing the boot plate relative the snowboard, and a latched condition, releasably mounting the boot plate to the snowboard until a sufficient second inertial force of at least a predetermined amount and in a direction from about 180° to about 360° relative the plane extending through the latch assembly causes the second latch mechanism to move to the unlatched condition.

33. The binding apparatus as defined in claim 32 wherein, said first latch mechanism includes a first inertia block having a selected mass and formed to retain the first latch mechanism in the latched position until the first inertial force dislodges the first inertia block from supportive contact with the first latch mechanism to cause the first latch mechanism to move to the unlatched position; and said second latch mechanism includes a second inertia block having a selected mass and formed to retain the second latch mechanism in the latched condition until the second inertial force dislodges the second inertia block from supportive contact with the second latch mechanism to cause the second latch mechanism to move to the unlatched condition.

34. The binding apparatus as defined in claim 33 further including:

a first biasing device operably coupled to the first latch mechanism which biases the first latch mechanism toward the unlatched position, and a second biasing device operably coupled to the second latch mechanism which biases the second latch mechanism toward the unlatched condition.

35. The binding apparatus as defined in claim 33 further including:

a base plate mountable to the snowboard, said second latch mechanism releasably mounting the base plate to the latch assembly in the latched condition, and releasing the base plate relative the latch assembly in the unlatched condition.

36. The binding apparatus as defined in claim 35 wherein, said first latch mechanism includes a first latch member movable between the latched position and the unlatched position, the boot plate defining a first receiving bore formed and dimensioned for sliding receipt of the first latch member to prevent relative movement between the boot plate and latch assembly in the latched position, and said first latch member being moved out of said receiving bore in the unlatched position, said second latch mechanism includes a second latch member movable between the latched condition and the unlatched condition, the base plate defining a second receiving bore formed and dimensioned for sliding receipt of the second latch member to prevent relative movement between the base plate and latch assembly in the latched condition, and said second latch member being moved out of said receiving bore in the unlatched condition.

37. The binding apparatus as defined in claim 36 wherein, said first latch mechanism further includes a first cam assembly operably coupled between the first inertia block and the first latch member urging the first latch member between the latched and unlatched position, and said second latch mechanism further includes a second cam assembly operably coupled between the second inertia block and the second latch member urging the second latch member between the latched and unlatched condition.

38. The binding apparatus as defined in claim 37 further including:

a first biasing device operably coupled to the first cam assembly which biases the first latch member toward the unlatched position, and a second biasing device operably coupled to the second cam assembly which biases the second latch member toward the unlatched condition.

39. The binding apparatus as defined in claim 36 wherein, said first inertia block is movable between a support position supportably retaining the first latch mechanism in the latched position, and a release position, releasing the first latch mechanism to the unlatched position in the event of said sufficient first inertial force, and said second block is movable between a support condition supportably retaining the second latch mechanism in the latched condition, and a release condition, releasing the second latch mechanism to the unlatched condition in the event of said sufficient second inertial force.

40. The binding apparatus as defined in claim 39 wherein, said first cam assembly includes a first lever member movable between:

a first position, corresponding to the first inertia block being in the support position, and a second position, upon the first inertia block moving to the release position, urging the first latch member toward the unlatched position, said second cam assembly includes a second lever member movable between:

a first condition, corresponding to the first inertia block being in the support condition, and a second condition, upon the second inertia block moving to the release condition, urging the second latch member toward the unlatched condition.

41. The binding apparatus as defined in claim 40 wherein, said latch assembly further includes:

a first biasing device operably coupled to the first lever member to bias the first lever member toward the second position such that the first latch member is moved toward the unlatched position, and a second biasing device operably coupled to the second lever member to bias the second lever member toward the second condition such that the second latch member is moved toward the unlatched position.

42. The binding apparatus as defined in claim 41 wherein, said latch assembly includes a housing defining a first cavity for horizontal movement of the first lever member between the first position and the second position, and a second cavity for horizontal movement of the second lever member between the first condition and the second condition.

43. The binding apparatus as defined in claim 42 further including:

a first reset mechanism operably coupled to the first lever member and said first inertia block, said first lever member being movable in said first cavity to a reset position to reset the first inertia block in supportive contact with the first latch member from the unlatched position to the latched position, and a second reset mechanism operably coupled to the second lever member and said second inertia block, said second lever member being movable in said second cavity to a reset condition to reset the second inertia block in supportive contact with the second latch member from the unlatched condition to the latched condition.

44. The binding apparatus as defined in claim 32 further including:

a first reset mechanism operably coupled to said first latch mechanism and said first inertia block to manually reset said first latch mechanism from the unlatched position to the latched position, and a second reset mechanism operably coupled to said second latch mechanism and said second inertia block to manually reset said second latch mechanism from the unlatched condition to the latched condition.

45. The binding apparatus as defined in claim 32 wherein, said first inertia block is movable between a support position supportably retaining the first latch mechanism in the latched position, and a release position, releasing the first latch mechanism to the unlatched position in the event of said sufficient first inertial force, and .

said second block is movable between a support condition supportably retaining the second latch mechanism in the latched condition, and a release condition, releasing the second latch mechanism to the unlatched condition in the event of said sufficient second inertial force.

* * * * *